US008573014B2

(12) United States Patent
Tsuritani

(10) Patent No.: US 8,573,014 B2
(45) Date of Patent: Nov. 5, 2013

(54) SPRING MANUFACTURING APPARATUS

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 992 days.

(21) Appl. No.: 12/350,736

(22) Filed: Jan. 8, 2009

(65) Prior Publication Data

US 2009/0173126 A1 Jul. 9, 2009

(30) Foreign Application Priority Data

Jan. 9, 2008 (JP) ..... 2008-002600

(51) Int. Cl.
*B21F 3/02* (2006.01)

(52) U.S. Cl.
USPC ..... 72/145; 72/140; 72/442; 72/446; 72/135

(58) Field of Classification Search
USPC ..... 72/135–145, 442, 446
See application file for complete search history.

(56) References Cited

U.S. PATENT DOCUMENTS 4,920,779 A 5/1990 Post
6,142,002 A 11/2000 Itaya
6,151,942 A * 11/2000 Itaya ..... 72/137
7,024,901 B2 4/2006 Yamaguchi et al.
7,134,305 B2 11/2006 Wu
2004/0154365 A1 * 8/2004 Tsuritani ..... 72/138
2006/0053853 A1 * 3/2006 Wu ..... 72/137

FOREIGN PATENT DOCUMENTS

JP 2-142633 A 5/1990
JP 10-109133 A 4/1998
JP 2000-61736 A 2/2000
JP 2003-290859 A 10/2003
JP 2004-237352 A 8/2004
JP 2005-28436 A 2/2005
JP 2006-95533 A 4/2006
JP 2007-30038 A 2/2007

* cited by examiner

*Primary Examiner* — Dana Ross
*Assistant Examiner* — Pradeep C Battula
(74) *Attorney, Agent, or Firm* — Birch, Stewart, Kolasch & Birch, LLP.

(57) ABSTRACT

A quill supporting member supporting a quill may include a movable body, e.g. Z-axis movable body that moves in a Z-axis direction of an XYZ orthogonal coordinate system representing a shaft core of the quill as an Z-axis. A tool holder supporting member supporting a tool holder for holding a tool may include the other movable bodies, e.g. an X-axis movable body that moves in an X-axis direction and a Y-axis movable body that moves in a Y-axis direction. Therefore, the quill is shortened in the Z-axis direction, and a contact area is reduced between a guide path of the quill and a wire rod.

20 Claims, 29 Drawing Sheets

SPRING MANUFACTURING APPARATUS

CROSS-REFERENCE TO RELATED APPLICATIONS

This Non-provisional application claims priority under 35 U.S.C. §119(a) on Patent Application No. 2008-002600 filed in Japan on Jan. 9, 2008, the entire contents of which are hereby incorporated by reference.

BACKGROUND OF THE INVENTION

1. Field of the Invention

The present invention relates to a spring manufacturing apparatus for processing a wire rod fed from a wire feed unit into a coil spring.

2. Description of Related Art

A conventional quill type spring manufacturing apparatus includes a frame to support on its front face, a tool holder that holds a tool for processing a wire rod into a coil spring. The frame has an opening part that is penetrated in a front and back direction. In addition, the frame provides a wire feed unit, on the backside, for feeding the wire rod. The wire feed unit provides a quill for guiding the wire rod. The quill is disposed in the opening part of the frame.

The frame includes an X-axis movable body that moves in an X-axis direction, a Y-axis movable body that moves in a Y-axis direction, and a Z-axis movable body that moves in a Z-axis direction, in an XYZ orthogonal coordinate system where an axial direction of the quill is represented as the Z-axis direction. Each movable body has a movable plate, and each of the total three movable plates includes a moving mechanism respectively, for moving the movable body in the X-axis direction, in the Y-axis direction, and in the Z-axis direction.

Japanese Unexamined Patent Publication No. 2007-30038 discloses a spring manufacturing apparatus that adjusts a relative position between the quill and the tool by moving each movable body to manufacture a coil spring.

SUMMARY OF THE INVENTION

Japanese Unexamined Patent Publication No. 2007-30038 discloses a spring manufacturing apparatus that arranges an X-axis movable body, a Y-axis movable body, and a Z-axis movable body in a superposing manner along a Z-axis direction. In addition, the opening part is formed along a Z-axis, as penetrating three movable plates for the X-axis movable body, the Y-axis movable body, and the Z-axis movable body. Therefore, as the number of the movable plates is increased, total sum of a thickness of each movable plate and a distance between movable plates are increased. The distance between movable plates then becomes longer in the Z-axis direction. In other words, the distance of the opening part in the Z-axis direction becomes longer in proportion to the thickness of the movable plate and the distance between movable plates.

In addition, a length of the quill in the Z-axis direction is determined in accordance with the distance of the opening part in the Z-axis direction. Accordingly, the length of the quill in the Z-axis direction becomes longer as the number of the movable plates is increased.

The quill provides a guide path at the shaft core for guiding the wire rod, and the wire feed unit provides a rotation mechanism for rotating the wire feed unit around a shaft core of the wire rod. The rotation mechanism rotates the wire feed unit with respect to the wire rod around the Z-axis, to adjust the relative position between the tool and the wire rod in the peripheral direction of the wire rod.

The rotation by the rotation mechanism allows to rotate the wire rod within the guide path. When the quill is longer in the Z-axis direction, a contact area between the wire rod and the guide path is increased. This increase of the contact area may cause to slide and twist the wire rod. Thus, a problem may occur that a dimension accuracy of the coil spring is influenced, when the twisted wire rod is processed into a coil spring.

The present invention has been made in view of the circumstance described above, and an object according to one of the aspects of the present invention is to provide a spring manufacturing apparatus that is capable of preventing a twist of the wire rod, by shortening the quill in the Z-axis direction and reducing the contact area between the guide path and the wire rod of the quill.

A spring manufacturing apparatus according to one of the aspects of the present invention comprises: a wire feed unit that feeds a wire rod; a quill that guides the wire rod fed from the wire feed unit; a quill supporting member that supports the quill; a tool holder that holds a tool which processes the wire rod into a coil spring; a tool holder supporting member that supports the tool holder; and an X-axis movable body that moves in an X-axis direction, a Y-axis movable body that moves in a Y-axis direction, a Z-axis movable body that moves in a Z-axis direction, in an XYZ orthogonal coordinate system representing an axial direction of the quill as the Z-axis direction; wherein one of the quill supporting member and the tool holder supporting member comprises one of the movable body among the X-axis movable body, the Y-axis movable body, and the Z-axis movable body; and the other one comprises the other movable bodies.

The above and further objects and features of the invention will more fully be apparent from the following detailed description with accompanying drawings:

DESCRIPTION OF THE PREFERRED EMBODIMENTS

Embodiment 1

Figure 1:
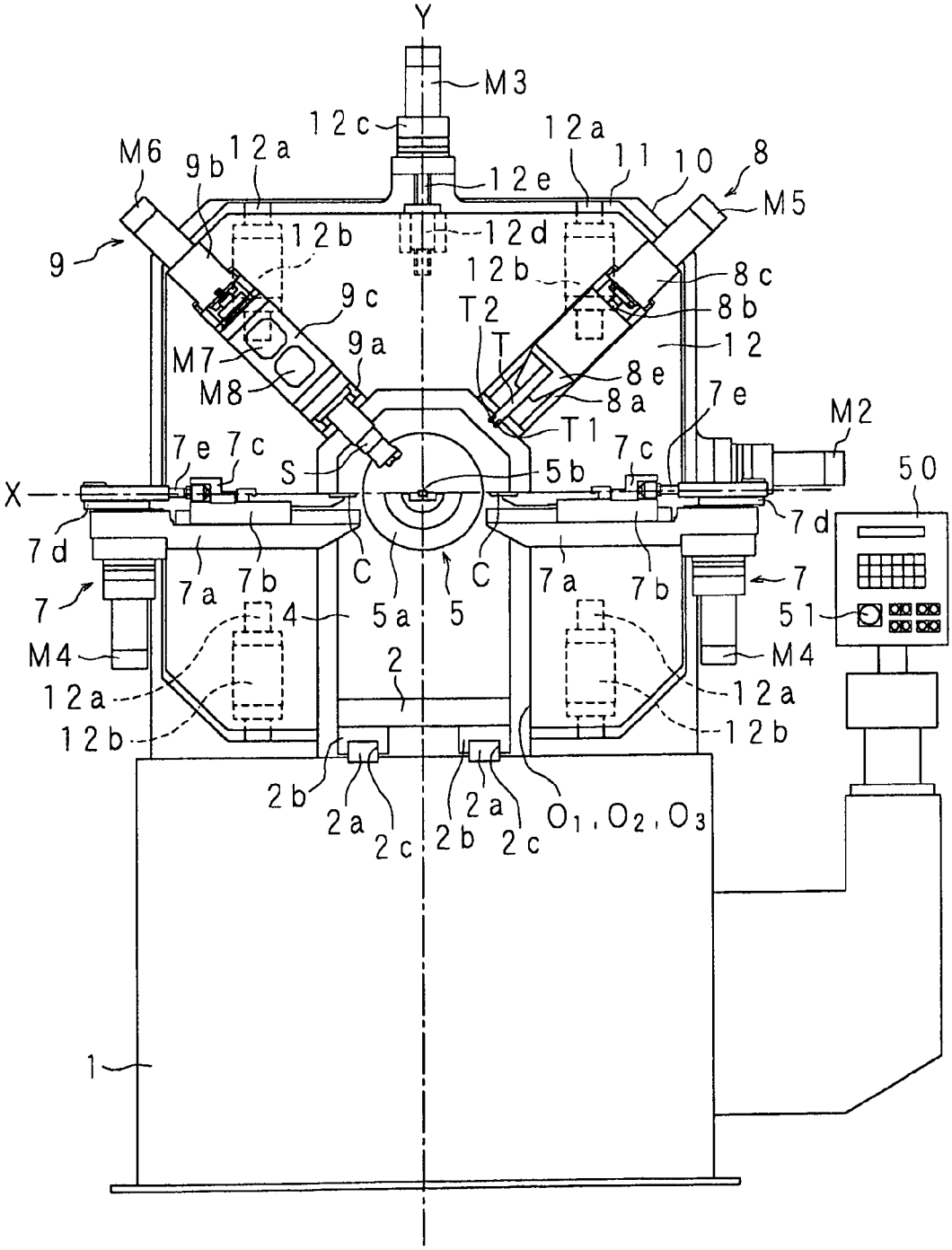
FIG. 1 is a schematic front view of a spring manufacturing apparatus according to Embodiment 1.
Figure 2:
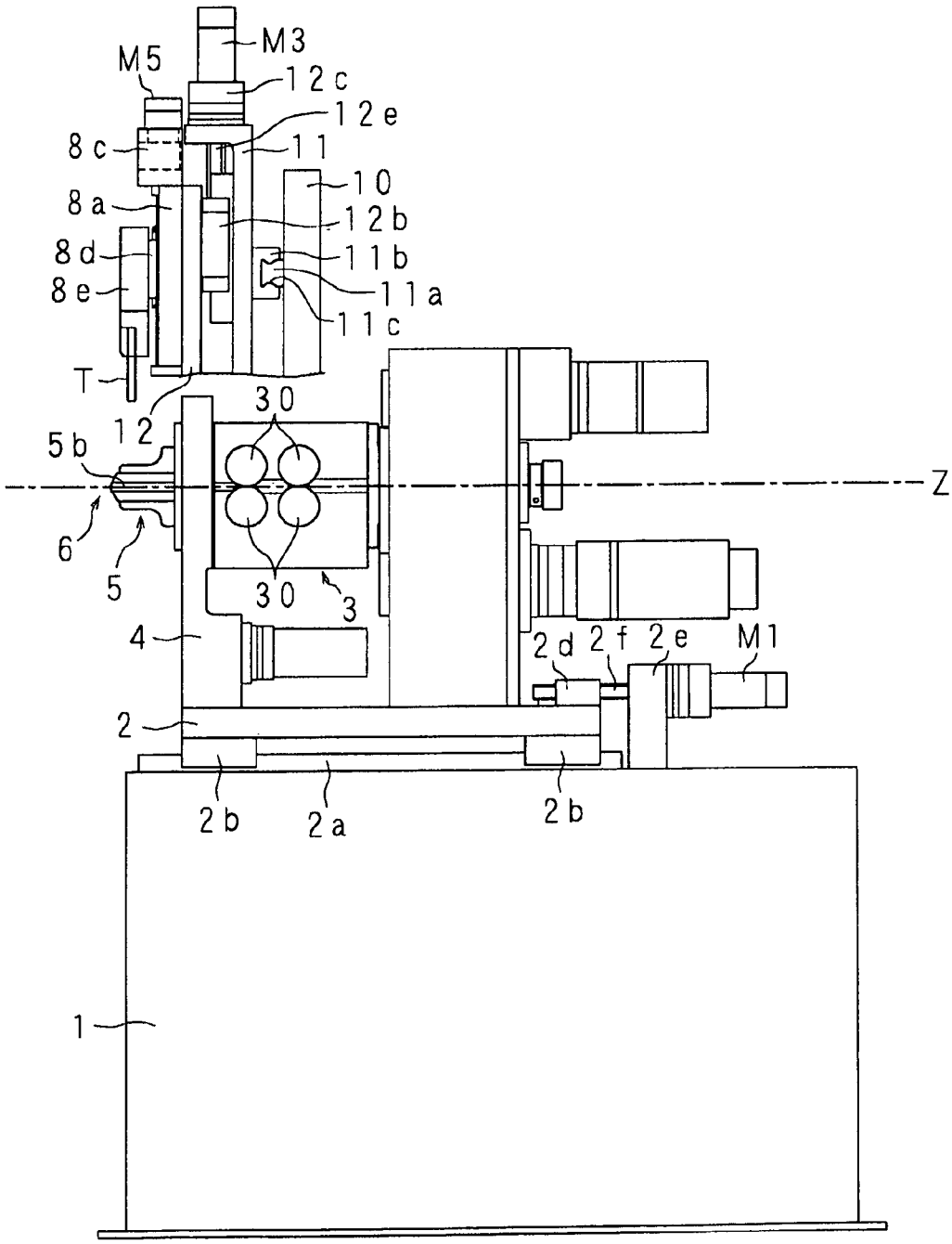
FIG. 2 is a schematic side view illustrating a wire feed unit of the spring manufacturing apparatus according to Embodiment 1.
Figure 3:
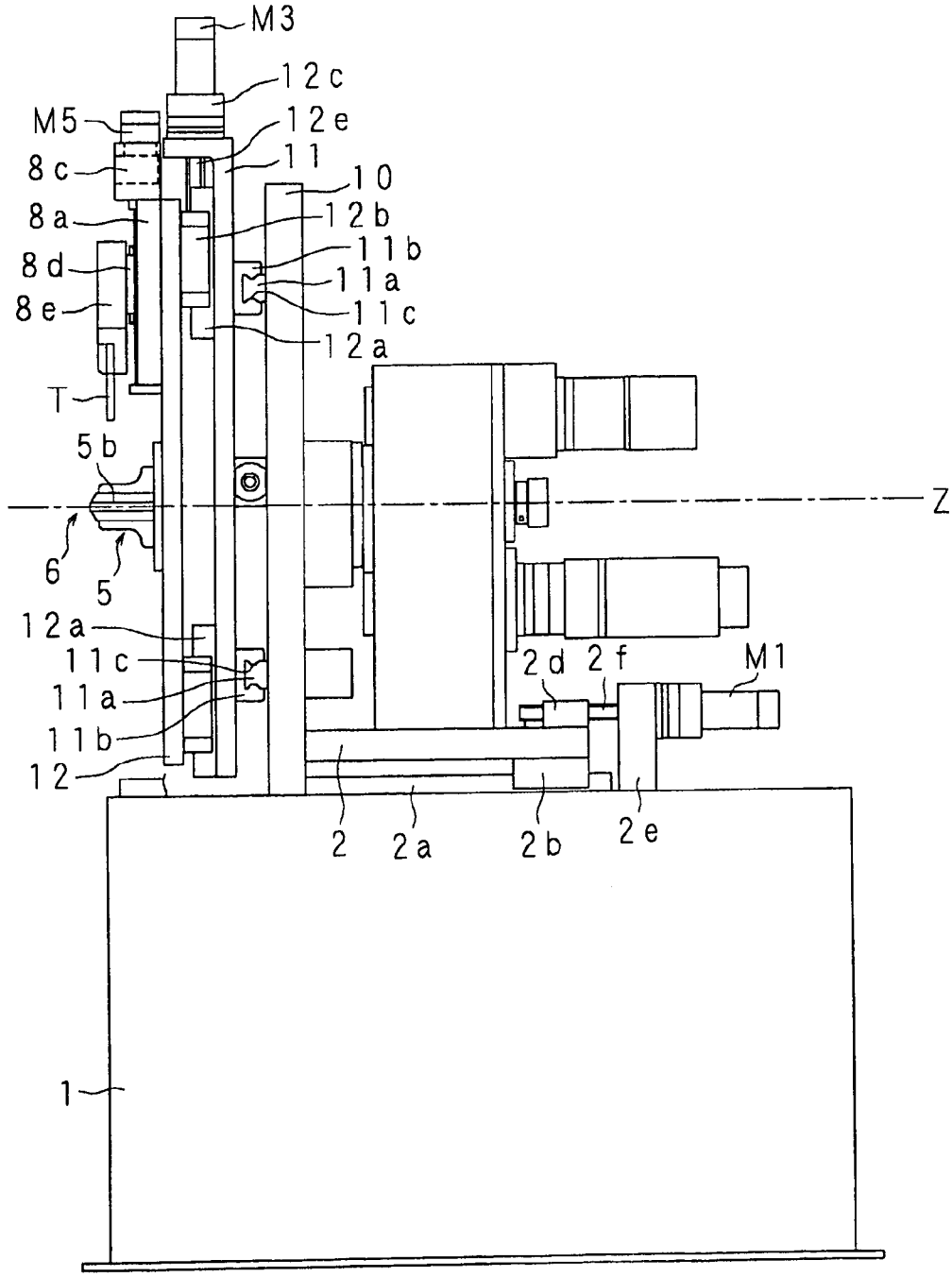
FIG. 3 is a schematic side view of the spring manufacturing apparatus according to Embodiment 1.
Figure 4:
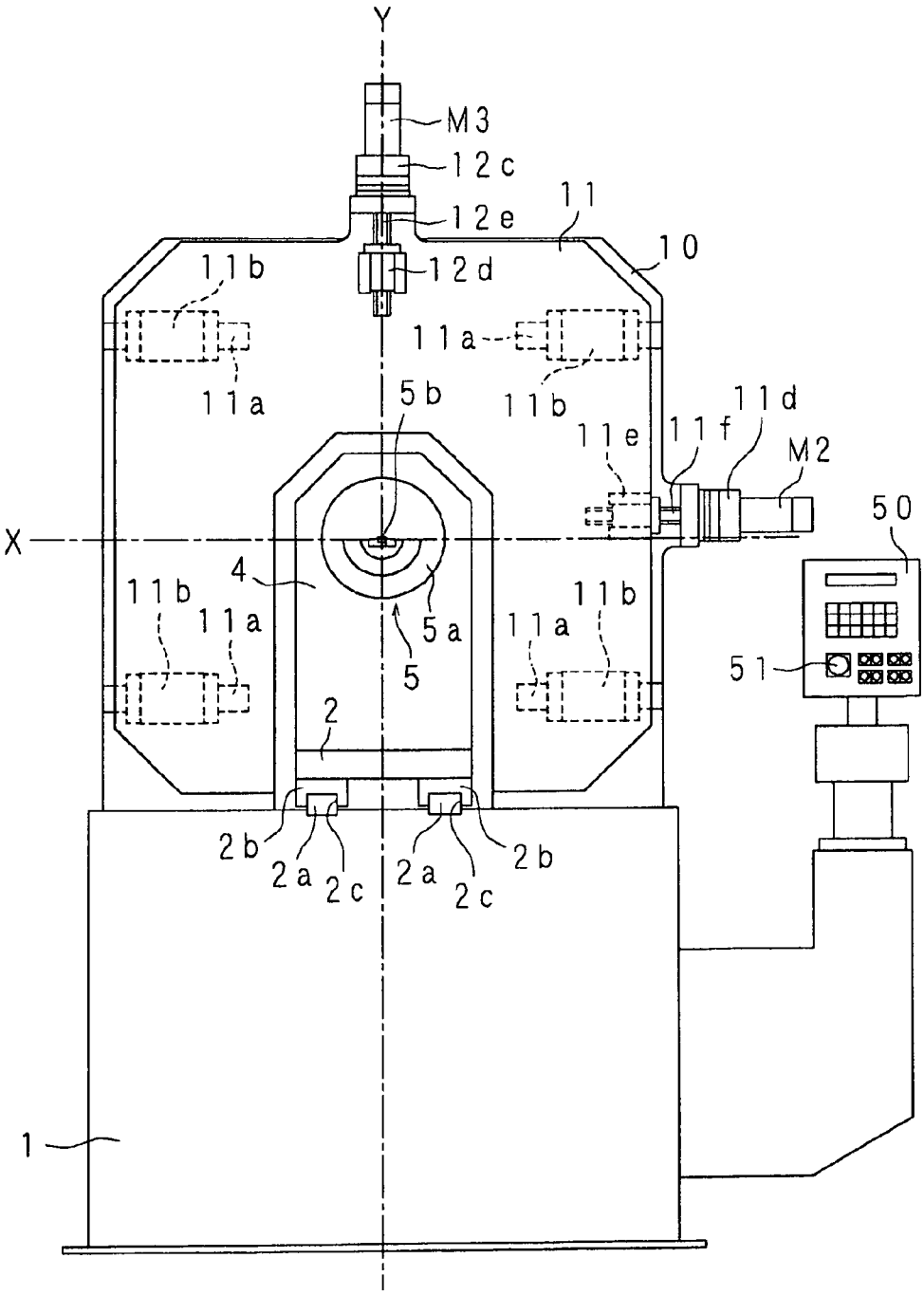
FIG. 4 is a schematic front view illustrating a moving mechanism that moves, in the X-axis direction, a tool holder of the spring manufacturing apparatus according to Embodiment 1.

The present invention will be described in detail below on the basis of the drawings showing a spring manufacturing apparatus according to Embodiment 1. FIG. 1 is a schematic front view of the spring manufacturing apparatus, FIG. 2 is a schematic side view illustrating a wire feed unit, FIG. 3 is a schematic side view of the spring manufacturing apparatus, and FIG. 4 is a schematic front view illustrating a moving mechanism that moves a tool holder in the X-axis direction.

In the drawings, numeral 1 indicates a box-shaped base of the spring manufacturing apparatus. The base 1 provides two rails 2*a*, 2*a* at the center of the upper surface that are arranged in parallel. The rails 2*a*, 2*a* extend in a front and back direction. On the rails 2*a*, 2*a*, a movable plate 2 is provided that moves in the front and back direction. The movable plate 2 includes a plurality of sliders 2*b*, 2*b*, . . . at the position opposed to the rails 2*a*, 2*a* that slide on the rails 2*a*, 2*a*. Each slider 2*b* is formed into approximately a rectangular parallelepiped shape, and provides a groove 2*c* on the surface opposed to the rail 2*a*. A sliding structure is configured by engagement between the grooves 2*c* and the rail 2*a*.

A nut part 2*d* is provided, at a backside of the spring manufacturing apparatus, on an upper surface of the movable plate 2. In addition, a block-like motor fixing part 2*e* is provided, on an upper surface of the base 1, behind the nut part 2*d*. The motor fixing part 2*e* provides a fitting hole, at the center, that is penetrated the motor fixing part 2*e* in the front and back direction and that fits a servo motor M1. The servo motor M1 fit in the motor fixing part 2*e* is capable of rotating forward and reverse, and has a male screw 2*f* that is connected to a rotating shaft of the servo motor M1 and that is screwed into the nut part 2*d*. The male screw 2*f* and the nut part 2*d* have groove parts that fit balls (not shown) in a rotational motion, for configuring a ball screw mechanism.

Forward/reverse rotation movement of the servo motor M1 is changed into a translatory movement by the male screw 2*f* and the nut part 2*d*. When the servo motor M1 carries out forward rotation, the sliders 2*b*, 2*b*, . . . slide on the rails 2*a*, 2*a* and the movable plate 2 moves to the front-side of the spring manufacturing apparatus along the Z-axis. When the servo motor M1 carries out reverse rotation, the movable plate 2 moves to a backside of the spring manufacturing apparatus along the Z-axis.

On an upper surface of the movable plate 2, a support plate 4 for supporting a quill 5 is arranged in a standing manner at a front-side of the spring manufacturing apparatus. On a backside of the support plate 4, a wire feed unit 3 for feeding a wire rod is provided. The wire feed unit 3 includes two pairs of wire feed rollers 30, 30 that are disposed above and bellow. The two rollers 30, 30 compress and hold the wire rod between them. When an upper side roller is rotated in a clockwise direction, a lower side roller is rotated in a counterclockwise direction, to feed the wire rod forward. The support plate 4 provides a through hole at the part opposed to the wire feed unit 3. At a front-side of the through hole, the quill 5 for guiding the wire rod is arranged. The quill 5 includes a semi-cylindrical body part 5*a*, and a guide path 5*b*. The guide path 5*b* is for guiding the wire rod and is provided in a shaft core part of the body part 5*a*.

The box-shaped base 1 keeps interiorly a bobbin (not shown) that winds the wire rod for supplying to the wire feed rollers 30 and 30. The wire rod is supplied via a capstan (not shown) from the bobbin to the wire feed rollers 30 and 30. The supplied wire rod passes the through hole by the wire feed rollers 30 and 30, to reach the quill 5. The wire rod is fed from the quill 5 to a wire rod processing space 6 for processing the wire rod. The wire rod processing space 6 is located at an exit of the quill 5.

In addition, the base 1 provides an operation part 50, at the side face, that is arranged in parallel to the Z-axis. It is configured to input information, by means of the operation part 50, that is required for manufacturing the spring, such as a winding direction of a coil part of the spring, a dimension of a manufactured spring (e.g. a length of the coil part, a bending position, and a length of a leg part), the kind of a tool used in the manufacture of the spring, and a fitting position of the tool, to a control circuit 60 that will be described later. The operation part 50 includes a switch 51 for inputting start and stop of manufacturing the spring.

The base 1 provides a support wall 10, on the top face, that is arranged in a standing manner to support a movable plate 11 and a movable plate 12. The support wall 10 provides an opening part $O_1$ that is formed to open in an arc shape from the base 1 side to a center part of the support wall 10. The quill 5 and the wire feed unit 3 are arranged to pass through the opening part $O_1$.

The support wall 10 provides a moving mechanism at the front-side. The moving mechanism moves a tool holder, described later, in the X-axis direction parallel to a top face of the base 1 and perpendicular to the Z-axis. As shown in FIG. 4, the movable plate 11 includes four rails 11*a*, 11*a*, . . . that are parallel to the X-axis and are respectively provided at four corners of a front face of the support wall 10. The movable plate 11 is approximately the same dimension as that of the support wall 10, and is disposed on a front side of the rails 11*a*, 11*a*, . . . . In addition, the movable plate 11 provides an opening part $O_2$ that is formed to open in the arc shape from the base 1 side to a center part of the movable plate 11. The quill 5 and the wire feed unit 3 are arranged to pass through the opening part $O_2$.

The movable plate 11 includes four sliders 11*b*, 11*b*, . . . that slide on the rails 11*a*, 11*a*, . . . , at a position opposed to the rails 11*a*, 11*a*, . . . . Each slider 11*b* is formed into approximately a rectangular parallelepiped shape, and provides a groove 11*c* on the surface opposed to the rail 11*a*. An engagement between the groove 11*c* and the rail 11*a* configures a sliding structure.

The support wall 10A provides a motor fixing part 11*d*, at the side close to the operation part 50, that is for fixing a servo motor M2. The motor fixing part 11*d* provides a fitting hole, at the center, that is penetrated the motor fixing part 11*d* in the X-axis direction to engage the servo motor M2. At a vicinity of the motor fixing part 11*d*, a nut part 11*e* is provided on the movable plate 11 between the support wall 10 and the movable plate 11. The motor fixing part 11*d* fixes the servo motor M2 that is capable of rotating forward and reverse, and a rotating shaft of the servo motor M2 is connected to a male screw 11*f* that is screwed into the nut part 11*e*. The male screw 11*f* and the nut part lie provide groove parts that fit balls (not shown) in a rotational motion, to configure a ball screw mechanism.

Forward/reverse rotation of the servo motor M2 is changed into a translatory movement by the male screw 11*f* and the nut part lie. Therefore, when the servo motor M2 carries out forward rotation, the sliders 11*b*, 11*b*, . . . slid on the rails 11*a*, 11*a*, . . . , and the movable plate 11 moves toward the operation part 50 along the X-axis. When the servo motor M2 carries out reverse rotation, the movable plate 11 moves away from the operation part 50.

As shown in FIG. 1, the movable plate 11 provides four rails 12*a*, 12*a*, . . . , at four corners of the front face respectively, that are arranged parallel to the Y-axis and orthogonal to the X-axis and the Z-axis. At a front side of the rails 12*a*, 12*a*, . . . , a movable plate 12 is arranged that has approximately the same dimension as that of the movable plate 11. The movable plate 12 provides an opening part $O_3$ that is formed to open in the arc shape from the base 1 side to the center part of the movable plate 12. Inside of this opening part $O_3$, the quill 5 and the wire feed unit are configured to move.

The movable plate 12 includes four sliders 12*b*, 12*b*, . . . , at the position opposed to the rails 12*a*, 12*a*, . . . respectively, that slide on the rails 12*a*, 12*a*, . . . . Each slider 12*b* is formed into approximately the rectangular parallelepiped shape, and provides a groove (not shown) that is formed on the surface opposed to the rail 12*a*. An engagement between the groove and the rail 12*a* configures a sliding structure.

The movable plate 11 provides a block-like motor fixing part 12*c*, on the far side to the base 1, that fixes a servo motor M3 described later. The motor fixing part 12*c* is formed to open a fitting hole that is penetrated in the Y-axis direction to fit the servo motor M3. At a vicinity of the motor fixing part 12*c*, a nut part 12*d* is provided on the movable plate 12 A between the movable plate 11 and the movable plate 12. The motor fixing part 12*c* fixes the servo motor M3 that is capable of rotating forward and reverse. A rotating shaft of the servo motor M3 is connected to a male screw 12*e* that is screwed into the nut part 12*d*. The male screw 12*e* and the nut part 12*d* provide groove parts that fit balls (not shown) in a rotational motion, to configure a ball screw mechanism.

The forward/reverse rotation of the servo motor M3 is changed into the translatory movement by the male screw 12*e* and the nut part 12*d*. When the servo motor M3 carries out forward rotation, the sliders 12*b*, 12*b*, . . . slide on the rails 12*a*, 12*a*, . . . , and the movable plate 12 moves away from the base 1 along the Y-axis. When the servo motor M3 carries out reverse rotation, the movable plate 12 moves toward the base 1.

As shown in FIG. 1, two crank slide units 7 and 7 are arranged at a front side of the movable plate 12. The two crank slide units 7 and 7 are disposed to sandwich the opening part $O_3$. Note that the crank slide units 7 and 7 are opposed to each other along the X-axis.

Each the crank slide unit 7 includes a rail table 7*a* having a rail and a plate-shaped slider 7*b* sliding on the rail. The slider 7*b* attaches a tool holder 7*c* that holds a cutter C. The rail table 7*a* attaches a servo motor M4 that is positioned apart from the slider 7*b*. The servo motor M4 has a rotating shaft that is connected to a crank 7*d*, and the crank 7*d* is connected to the slider 7*b* with a rod 7*e*.

A rotating movement of the servo motor M4 is changed to the translatory movement by the crank 7*d* and the rod 7*e*, and moves the cutter C that is held by the tool holder 7*c*, toward and away from the wire rod processing space 6.

The movable plate 12 provides a wire rod processing unit 8, at the close side to the operation part 50 and at the far side to the base 1. The wire rod processing unit 8 includes a long box 8*a* housing a male screw 8*b* as a tool for processing the wire rod. The box 8*a* is disposed, on the front face of the movable plate 12, with its one end portion directed to the wire rod processing space 6 and inclined by approximately 45 degrees with respect to the X-axis and the Y-axis. The other end portion of the box 8*a* provides a block-like motor fixing part 8*c* for fixing a servo motor M5. The motor fixing part 8*c* is formed to open a fitting hole (not shown), at the center, that penetrates the box 8*a* in a longitudinal direction and that fits the servo motor M5.

The male screw 8*b* screw a nut part 8*d*. The male screw 8*b* and the nut part 8*d* provide balls (not shown) in a rotational motion, to configure a ball screw mechanism. The nut part 8*d* A provides a tool holder 8*e* that attaches a bending die T for applying bending processing to the wire rod. The bending die T is arranged to direct the tip end to the wire rod processing space 6. The bending die T provides a left winding groove T1 and a right winding groove T2.

Forward/reverse rotation of the servo motor M5 is changed into the translatory movement by the male screw 8*b* and the nut part 8*d*. When the servo motor M5 carries out forward rotation, the bending die T moves toward the wire rod processing space 6 along the male screw 8*b*. When the servo motor M5 carries out reverse rotation, the bending die T moves away from the wire rod processing space 6. Note that the male screw 8*b*, the servo motor M5, and the nut part 8*d* configure an advancing and retreating mechanism that makes the tool holder 8*e* move towards and away from the wire rod processing space 6.

The movable plate 12 provides a wire rod processing unit 9 at the far side to the operation part 50 and the base 1. The wire rod processing unit 9 includes a long box 9*a* housing a male screw (not shown) as the tool for processing the wire rod. The box 9*a* is disposed, at a front side of the movable plate 12, with its one end portion directed to the wire rod processing space 6 and inclined by approximately 45 degrees with respect to the X-axis and the Y-axis. The other end portion of the box 9*a* provides a block-like motor fixing part 9*b* that fixes a servo motor M6. The motor fixing part 9*b* is formed to open a fitting hole (not shown), at the center, that penetrates the box 9*a* in a longitudinal direction and that fits the servo motor M6.

The male screw screws into a nut part (not shown). The male screw and the nut part provide groove parts that fit balls (not shown) in a rotational motion, to configure a ball screw mechanism. The nut part provides a spindle operation device 9*c* that attaches a spindle S for bending the wire rod. The spindle S is arranged to direct the tip end to the wire rod processing space 6.

Forward/reverse rotation of the servo motor M6 is changed into the translatory movement by the male screw and the nut part. When the servo motor M6 carries out forward rotation, the spindle S moves toward the wire rod processing space 6 along the male screw. When the servo motor M6 carries out reverse rotation, the spindle S moves away from the wire rod processing space 6.

Figure 5:
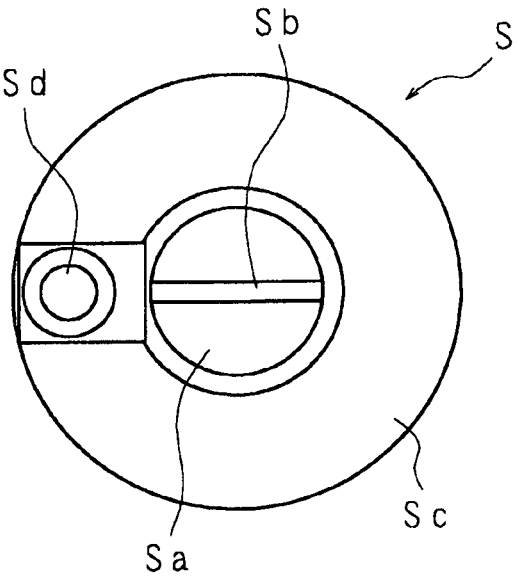
FIG. 5 is a schematic bottom view illustrating a spindle of the spring manufacturing apparatus according to Embodiment 1.

Next, a structure of the spindle will be described. FIG. 5 is a schematic bottom view illustrating the spindle.

The spindle operation device 9*c* is connected to two servo motors M7 and M8 at the side face. The spindle S includes an inner cylinder Sa and an outer sleeve Sc that is positioned around a circumference of the inner cylinder Sa. The inner cylinder Sa provides a slotted groove Sb, on the tip end surface, that engages the wire rod. In addition, the outer sleeve Sc provides a protrusion Sd, at the tip end portion, that bends the wire. The two servo motors M7 and M8 are connected to the inner cylinder Sa and the outer sleeve Sc, respectively.

The inner cylinder Sa is configured to rotate by the rotation of the servo motor M7. Furthermore, the outer sleeve Sc is configured to rotate in the counter-clockwise direction viewed from bottom side when the servo motor M8 carries out forward/reverse rotation. When the servo motor M8 carries out reverse rotation, the outer sleeve Sc rotates in the clockwise direction viewed from the bottom side.

Figure 6:
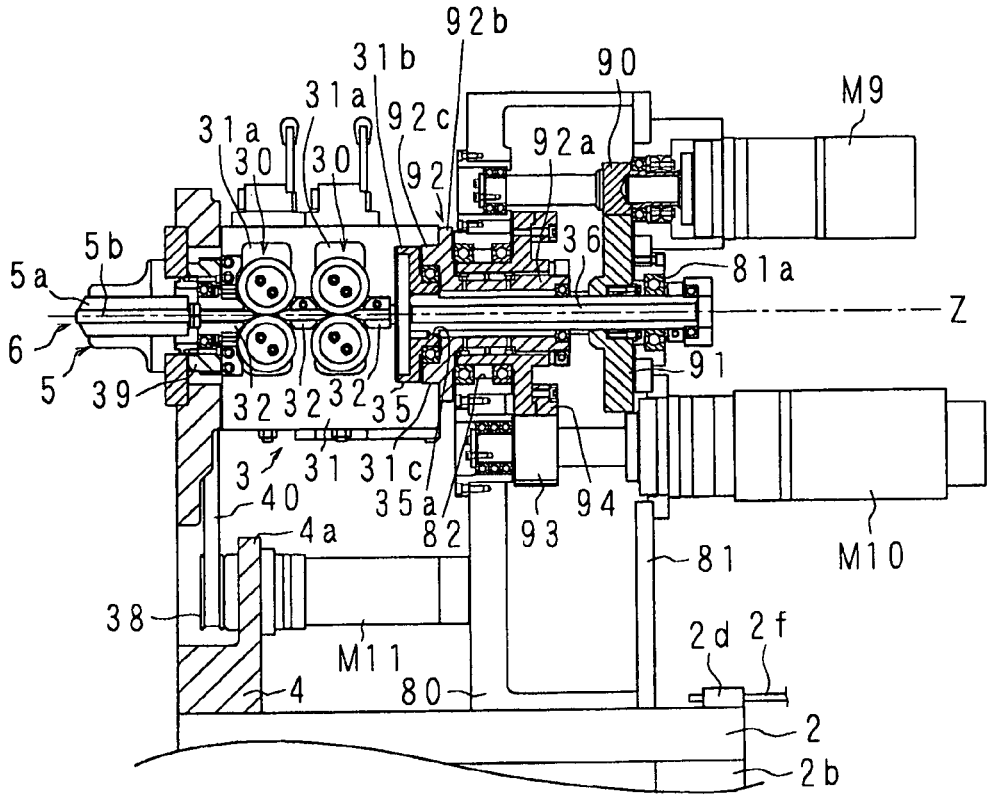
FIG. 6 is a schematic side part sectional view of the spring manufacturing apparatus according to Embodiment 1.

Next, a mechanism of feeding the wire rod will be described. FIG. 6 is a schematic sectional view of a side part of the spring manufacturing apparatus.

The movable plate 2 provides an intermediate wall 80 that is located at a back side of the support plate 4. Further, the movable plate 2 provides a back face wall 81 that is on a backside of the intermediate wall 80. The intermediate wall 80 is formed an intermediate hole 82 that penetrates the intermediate wall 80. The back face wall 81 is formed an opening hole 81*a*. Each of the intermediate hole 82 and the hole 81*a* has a shaft center that is arranged on the Z-axis, as well as the shaft center of the guide path 5*b* of the quill 5.

Between the support plate 4 and the intermediate wall 80, the wire feed unit 3 is arranged that includes a casing 31, the wire feed rollers 30, 30, and a plurality of transmission gears (not shown) that are cased in the casing 31 and transmit the rotation of a servo motor M9, described later, to the wire feed rollers 30, 30.

The casing 31 is formed two windows 31*a*, 31*a* on the side face. From each window 31*a*, 31*a*, an upper shaft and a lower shaft (not shown) extends to the outside with suitable length. The pair of shafts is utilized for transmitting the rotation of the transmission gears. Each shaft is connected to a roller at the extended end portion. Thus, the wire feed rollers 30, 30 are arranged along the side face of the casing 31. The casing 31 provides three guide blocks 32, 32, 32 at the side face. These guide blocks 32, 32, 32 include grooves for guiding the wire rod and are arranged between the wire feed rollers 30 and 30, on the upper stream side and on the lower stream side, respectively. In addition, the casing 31 provides a fitting hole 31*c*, on the backside, that fits a fitting part 92*c* which will be described.

The casing 31 provides an annular gear 35, at the backside, that has a fitting hole 35*a* at the center. The fitting hole 35*a* is utilized to fit a cylinder 36 for passage that will be described later. The casing 31 provides a rear window 31*b* on the side face, at the backside, and the annular gear 35 is exposed from the rear window 31*b*. The annular gear 35 is arranged with the shaft center parallel to the Z-axis. The annular gear 35 is meshed with the transmission gear, and then the rotation of the annular gear 35 is transmitted to the transmission gear.

The fitting hole 35*a* fits one end portion of the cylinder 36 for passage that passes the wire. In addition, the cylinder 36 for passage is inserted into the intermediate hole 82, and the hole 81*a* fits the other end portion of the cylinder 36 for passage via a bearing.

The cylinder 36 for passage externally fit a driven gear 91, at a vicinity of the other end portion, between the intermediate wall 80 and the back face wall 81. The driven gear 91 is meshed with a main driving gear 90 as will be described later. The back face wall 81 attaches the servo motor M9, above an top side of the cylinder 36 for passage. The servo motor M9 has a shaft core that is engaged with the main driving gear 90, and the main driving gear 90 is meshed with the driven gear 91. The rotation of the servo motor M9 is configured to transmit to the driven gear 91 via the main driving gear 90, followed by rotating the cylinder 36 for passage.

The rotation of the servo motor M9 rotates the annular gear 35 that fits the cylinder 36 for passage, through the rotation of the cylinder 36 for passage. This configuration lead to feed the wire rod by the rotation of the wire feed rollers 30, 30 via the transmission gears.

The casing 31 provides a hub 92 on the back face. The hub 92 is utilized for transmitting the rotation of a servo motor M10, described later, to the casing 31. The hub 92 includes a cylindrical part 92*a*, a shoulder part 92*b* that contacts one end portion of the cylindrical part 92*a*, and a fitting part 92*c* that extends from the shoulder part 92*b* to the opposite side to the cylindrical part 92*a* and fits the fitting hole 31*c* of the casing 31. In addition, the shoulder part 92*b* closely contacts the back face of the casing 31. Further, the cylindrical part 92*a* externally fits the cylinder 36 for passage via the bearing in a rotational motion, and is inserted into the intermediate hole 82.

The cylindrical part 92*a* internally fits a driven gear 94. The driven gear 94 consists of a gear part and a boss part that projects to one side. The boss part externally fits the cylindrical part 92*a*, and is supported in a rotational motion by the intermediate hole 82 via the bearing. The gear part is disposed closer to the intermediate wall 80, between the intermediate wall 80 and the back face wall 81.

The servo motor M10 is attached to the back face wall 81 under the cylinder 36 for passage, and has a rotating shaft that engages the main driving gear 93 which meshes with the driven gear 94. The rotation of the servo motor M10 is transmitted to the driven gear 94 via the main driving gear 93. These configurations lead to rotate the wire rod, around the Z-axis, that is compressed and held by the wire feed rollers 30, 30, through the rotation of the casing 31 around the Z-axis.

The support plate 4 provides a motor fixing part 4*a*, at the lower part, for fixing a servo motor M11. The motor fixing part 4*a* provides a fitting hole (not shown) that fits the servo motor M11. In addition, the servo motor M11 has the rotating shaft that is connected to a pulley 38.

Furthermore, the quill 5 is connected to a pulley 39, and two pulleys 38 and 39 suspend a belt 40. The rotation of the servo motor M11 is transmitted to the quill 5, via the pulleys 38, 39, and the belt 40. Thus, the quill 5 is configured to rotate around the Z-axis.

Figure 7A:
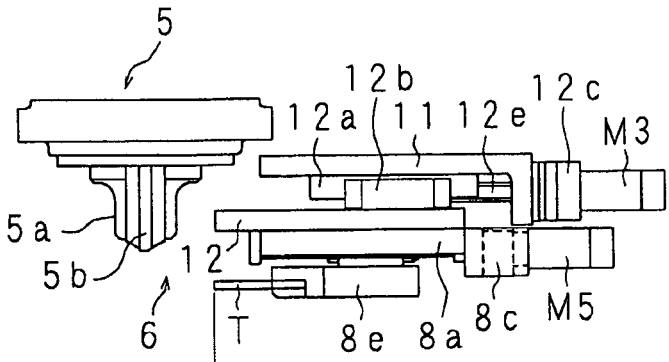
FIGS. 7A to 7C are explanatory views each explaining movement of a bending die and a quill of the spring manufacturing apparatus according to Embodiment 1.
Figure 7B:
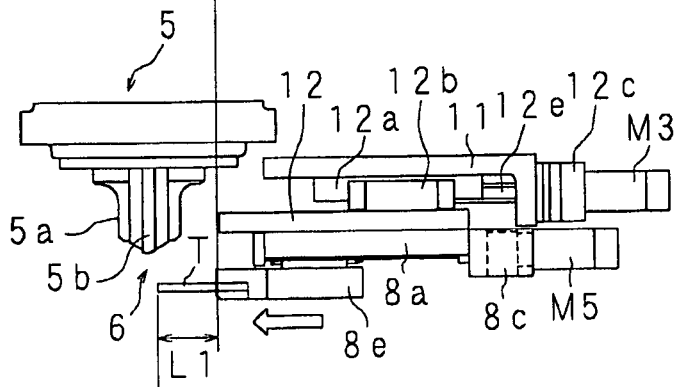
Figure 7C:
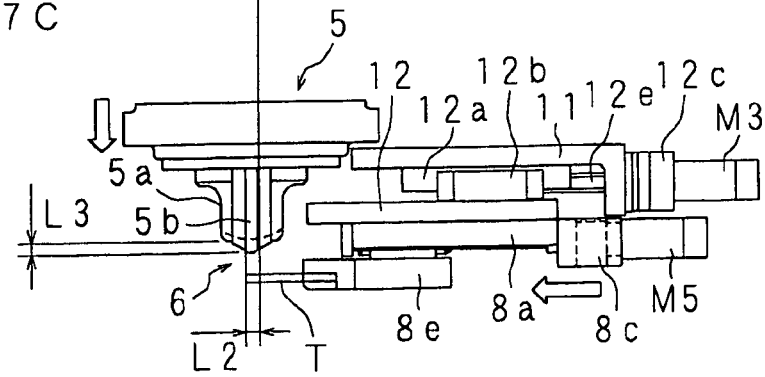

Next, movement of the tool and the movable plate will be described. FIGS. 7A to 7C are explanatory views each explaining the movement of the bending die T and the quill 5. FIG. 7A is a view illustrating a state in which the bending die T is still at a position isolated from the wire rod processing space 6. FIG. 7B is a view illustrating a state in which the bending die T is moved by the servo motor M5. FIG. 7C is a view illustrating a state in which the bending die T is moved by the movement of the movable plate 2. Note that L1 of FIG. 7B indicates a distance of the movement of the bending die T from the position shown in FIG. 7A to the position shown in FIG. 7B, by the rotation of the servo motor M5. L2 of FIG. 7C shows the distance of the movement of the bending die T from the position shown in FIG. 7B to the position shown in FIG. 7C, by the movement of the movable plate 11 and the movable plate 12. L3 shows the distance of the movement of the quill 5 from the position shown in FIG. 7B to the position shown in FIG. 7C, by the movement of the movable plate 2. Note that the movable plate 2 and the servo motor M1 are omitted, in FIGS. 7A to 7C.

When the wire rod is processed, the rotation of the servo motor M5 slides the tool holder 8*d* as shown by a hollow arrow of FIG. 7B. Then, the bending die T moves, by distance L1, toward the wire rod processing space 6. The servo motors M2 and M3 then move the two movable plates 11 and 12, as shown by a hollow arrow of FIG. 7C. As a result, the bending die T moves by distance L2. Furthermore, the servo motor M1 moves the movable plate 2, for moving the quill by distance L3.

The servo motor M5 is utilized to move the bending die T into the wire rod processing space 6 at a high speed. The servo motors M1 to M3 are utilized, after the movement of the bending die T into the wire rod processing space 6, to adjust finely the relative position between the bending die T and the quill 5 through the movement of the movable plate 11, the movable plate 12, and the movable plate 2.

Figure 8:
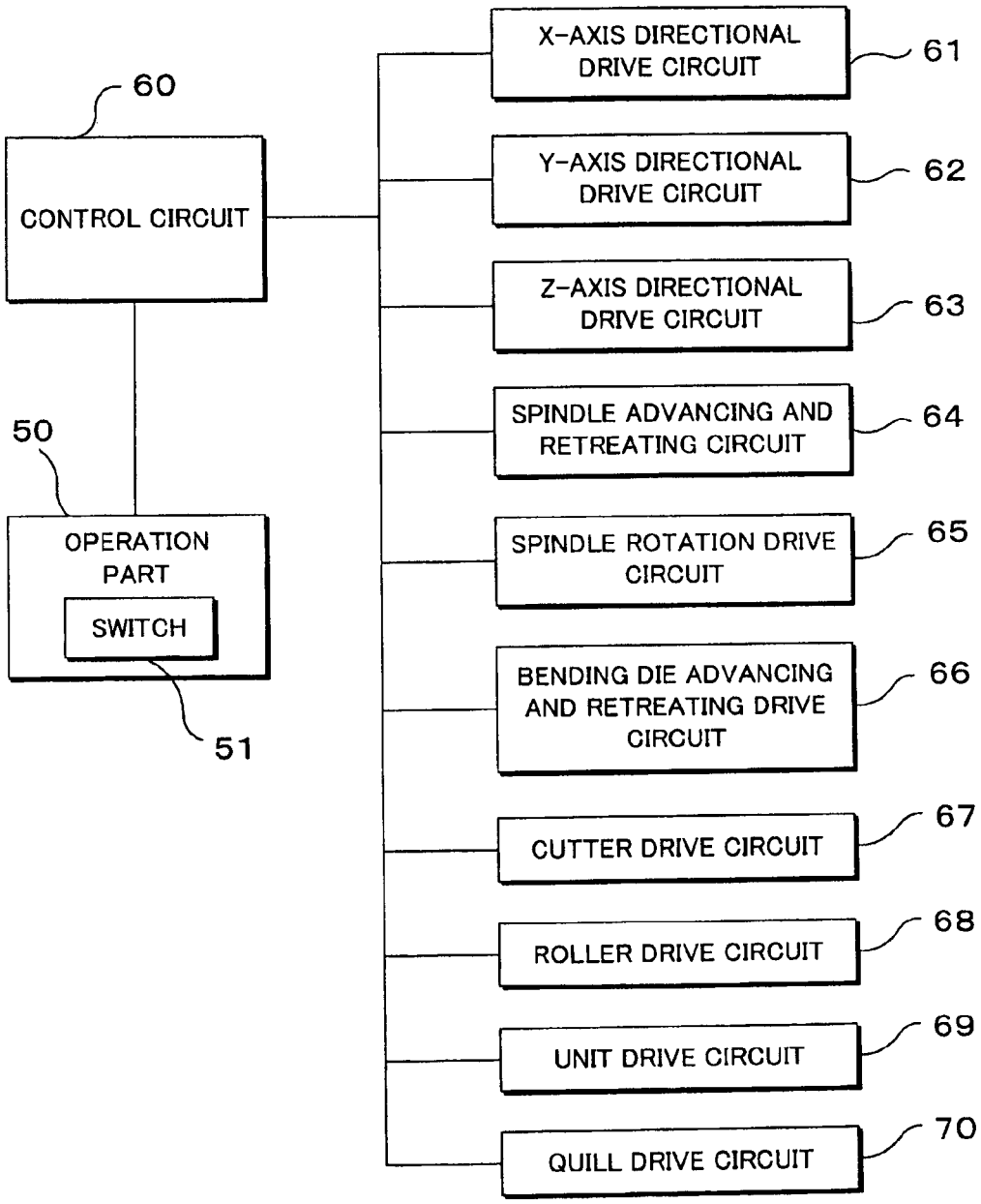
FIG. 8 is a block diagram according to Embodiment 1, illustrating a structure of an essential part in the vicinity of a control circuit for controlling rotation of each servo motor.

Next, it will describe about the manufacture of a coil spring by means of the spring manufacturing apparatus. FIG. 8 is a block diagram illustrating a structure of an essential part at a vicinity of a control circuit for controlling the rotation of each servo motor.

The operation part 50 includes a control circuit 60 for controlling servo motors M1 to M11 to rotate forward and reverse, respectively. The control circuit 60 consists of a CPU that outputs a rotation signal to a drive circuit, described later, an ROM that stores a control program for controlling the forward and reverse rotation of the servo motors M1 to M11, and an RAM that temporally stores information which are inputted from the operation part 50.

The control circuit 60 is connected to an X-axis directional drive circuit 61 for driving the servo motor M2 and moving the movable plate 11 in the X-axis direction; an Y-axis directional drive circuit 62 for driving the servo motor M3 and moving the movable plate 12 in the Y-axis direction; a Z-axis directional drive circuit 63 for driving the servo motor M1 and moving the movable plate 2 in the Z-axis direction; a spindle advancing and retreating drive circuit 64 for driving the servo motor M6 and moving the spindle S toward and away from the wire rod processing space 6; a spindle rotation drive circuit 65 for driving the servo motors M7 and M8 and rotating an outer sleeve Sc and the inner cylinder Sa; a bending die advancing and retreating drive circuit 66 for driving the servo motor M5 and moving the bending die T toward and away from the wire rod processing space 6; a cutter drive circuit 67 for driving the servo motors M4 and M4 and moving a cutter C toward and away from the wire rod processing space 6; a roller drive circuit 68 for driving the servo motor M9 and feeding the wire rod by using the wire feed rollers 30 and 30; a unit drive circuit 69 for driving the servo motor M10, and rotating the wire feed unit 3; and a quill drive circuit 70 for driving the servo motor M11, and rotating the quill 4. It is configured that the control circuit 60 respectively outputs the rotation signal to the drive circuits 61 to 70 and then the servo motors M1 to M11 respectively carry out predetermined number of rotations.

Figure 9A:
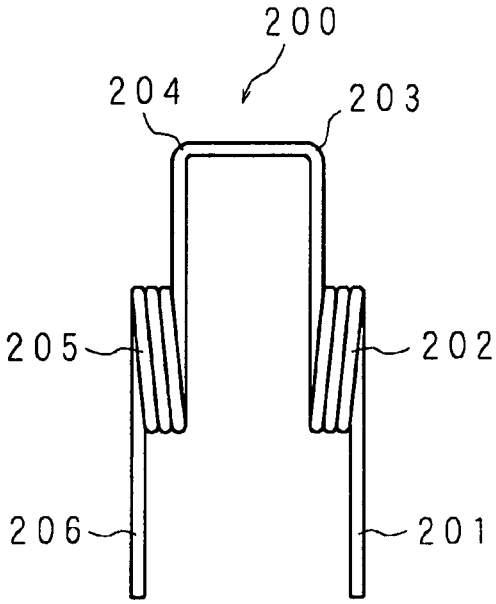
FIGS. 9A and 9B are views each illustrating a spring that is manufactured by the spring manufacturing apparatus according to Embodiment 1.
Figure 9B:
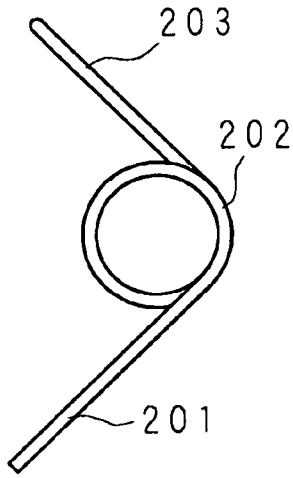
Figure 10:
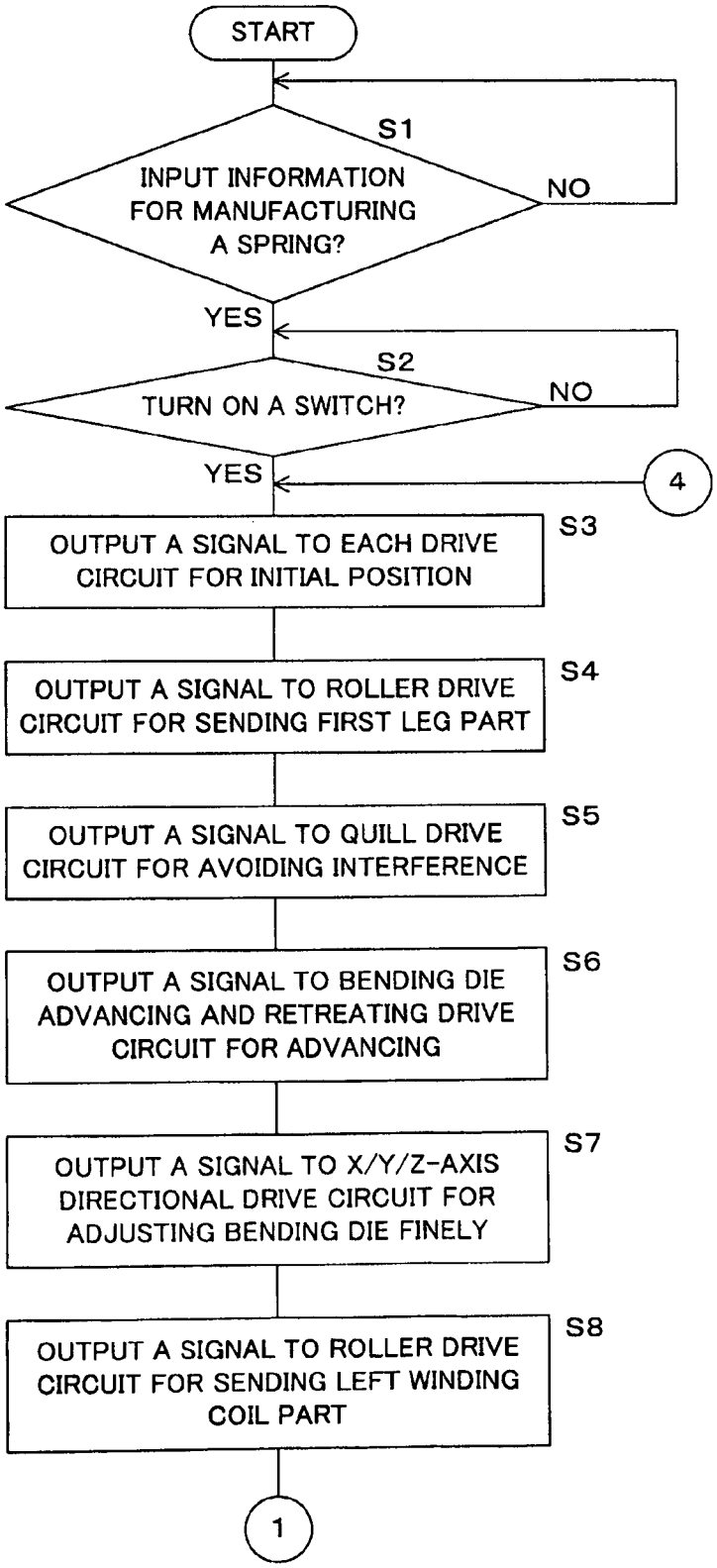
FIG. 10 is a flowchart illustrating manufacturing processing of the spring of the spring manufacturing apparatus according to Embodiment 1.
Figure 11:
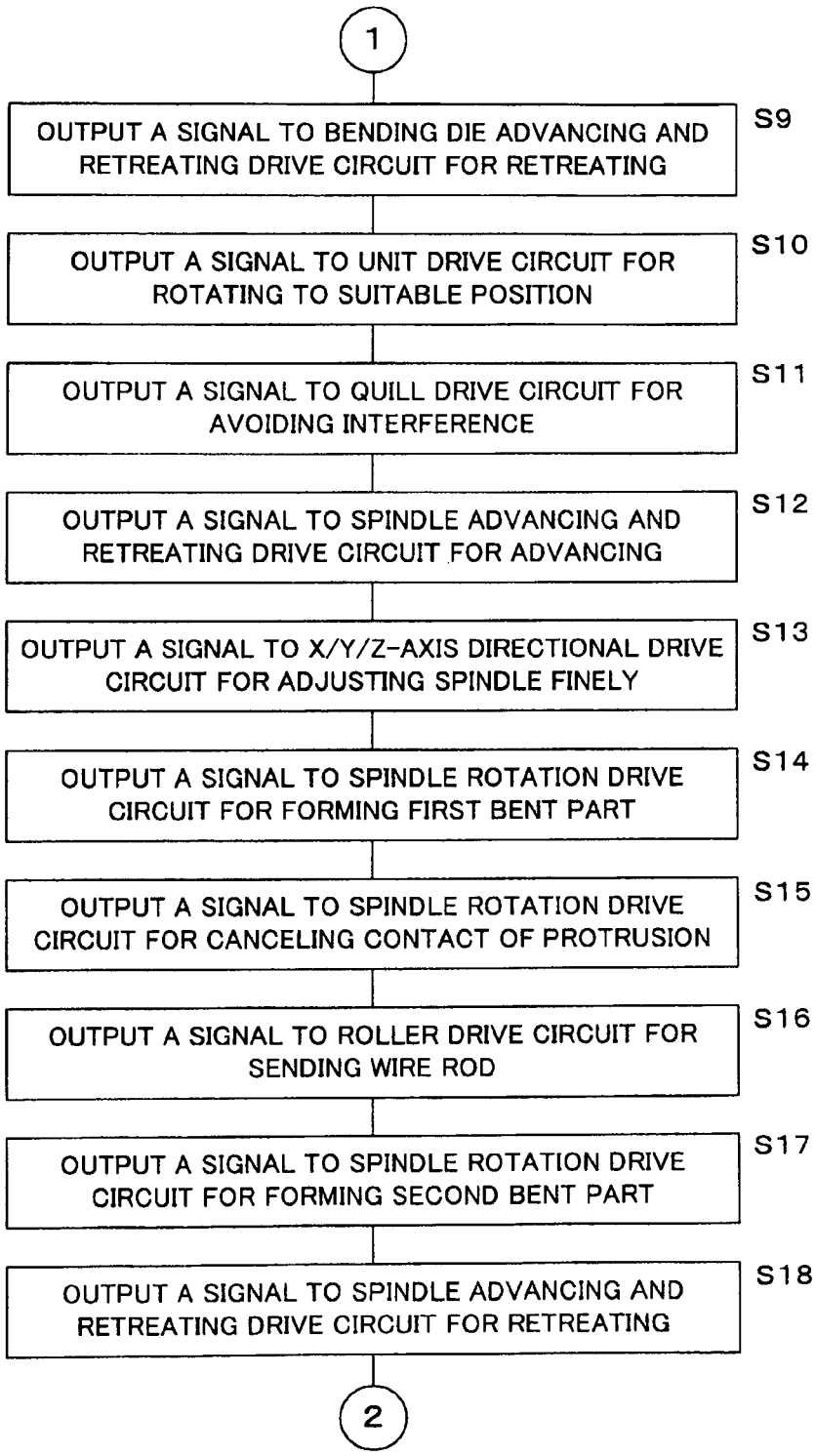
FIG. 11 is a flowchart illustrating the manufacturing processing of the spring of the spring manufacturing apparatus according to Embodiment 1.
Figure 12:
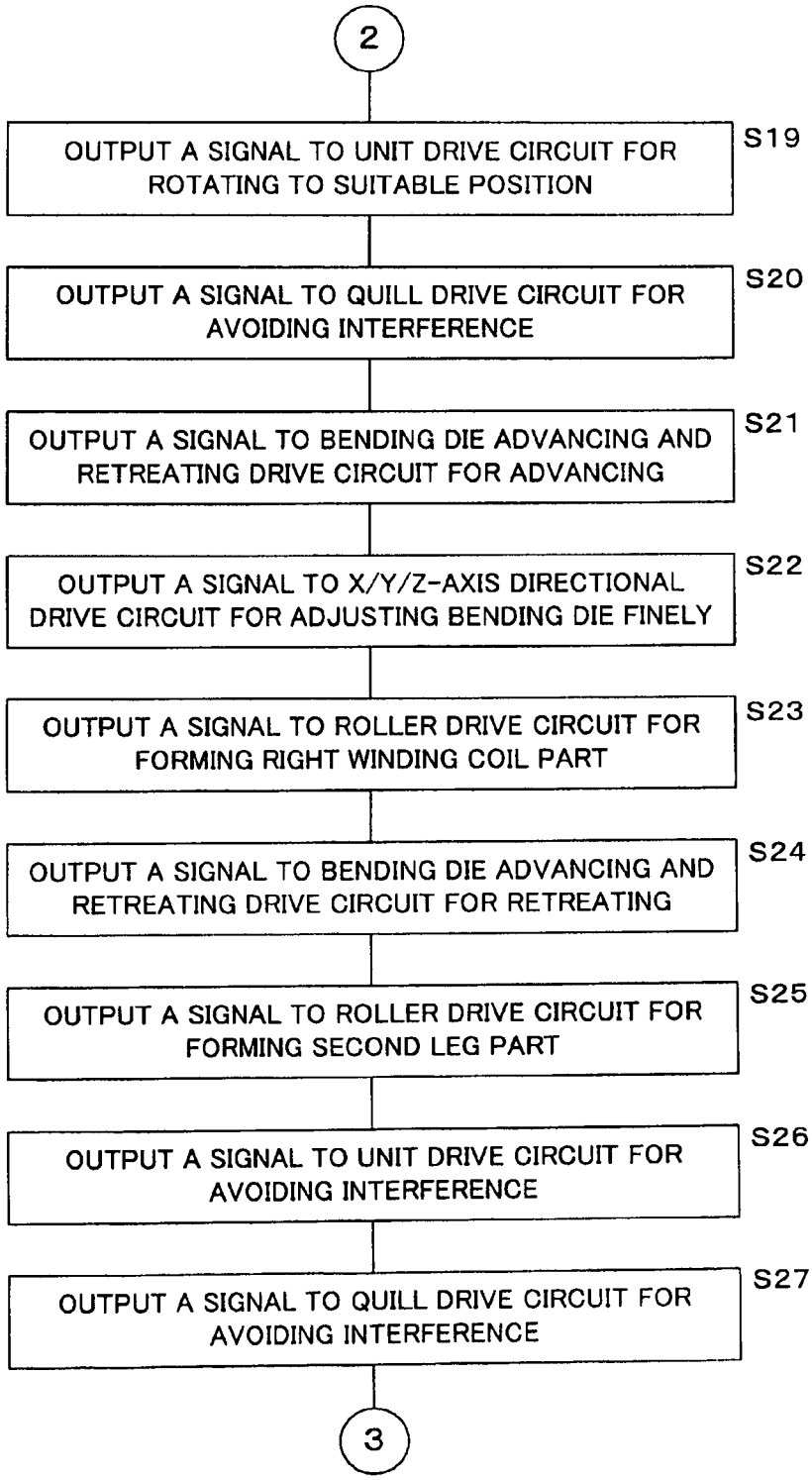
FIG. 12 is a flowchart illustrating the manufacturing processing of the spring of the spring manufacturing apparatus according to Embodiment 1.
Figure 13:
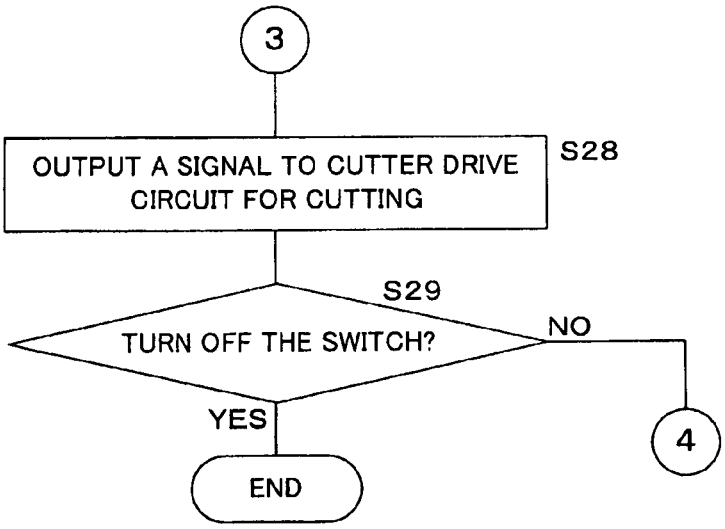
FIG. 13 is a flowchart illustrating the manufacturing processing of the spring of the spring manufacturing apparatus according to Embodiment 1.

FIGS. 9A and 9B are views each illustrating a spring that is manufactured by the spring manufacturing apparatus. FIG. 9A is a schematic front view of the spring, and FIG. 9B is a schematic side view of the spring.

A spring 200 includes a straight line-shaped first leg part 201, and the first leg part 201 continues into a left winding coil part 202. The left winding coil part 202 continues into a first bent part 203 that bends substantially right angle to be parallel to an axis center direction of winding of the left winding coil part 202. In addition, the first bent part 203 continues into a second bent part 204 that bends right angle to the axis center of winding of the left winding coil part 202. The second bent part 204 continues into a right winding coil part 205 from the end portion. The right winding coil part 205 continues into a straight line shaped second leg part 206.

FIG. 10 to FIG. 13 are flowcharts illustrating a manufacturing processing of the spring. The manufacturing processing of the spring here means the processing of manufacturing the spring through controlling each servo motor on the basis of the information that the operation part inputs to the control circuit. FIG. 14A to FIG. 19B are explanatory views explaining the movement of the spindle S, the bending die T, the quill 5, and the wire rod. In FIG. 14A to FIG. 19B, (i) is a schematic front view of the spindle S, the bending die T, the quill 5, the wire rod, (ii) is a schematic bottom view of the spindle S, the bending die T, the quill 5, and the wire rod, with the quill 5 set as a reference, and (iii) is a schematic side view on the basis of (ii).

The control circuit 60 judges whether or not all information required for manufacturing the spring 200 is inputted with the use of the operation part 50 (step S1). The information in this case means, such as the dimension of the spring 200, the kind of the tool used in manufacturing the spring 200, the attachment position of the tool, or the like. When all the information required for manufacturing the spring 200 is not inputted (NO: step S1), the processing returns to step S1. When all the information required for manufacturing the spring 200 is inputted (YES: step S1), the control circuit 60 judges whether or not a switch 61 is turned on (step S2). When the switch 61 is not turned on (NO: step S2), the processing returns to step S2. When the switch 61 is turned on (YES: step S2), the control circuit 60 respectively outputs the rotation signal to the drive circuits 61 to 70 and then the servo motors M1 to M11 respectively carry out forward and reverse rotation.

Figure 14B:
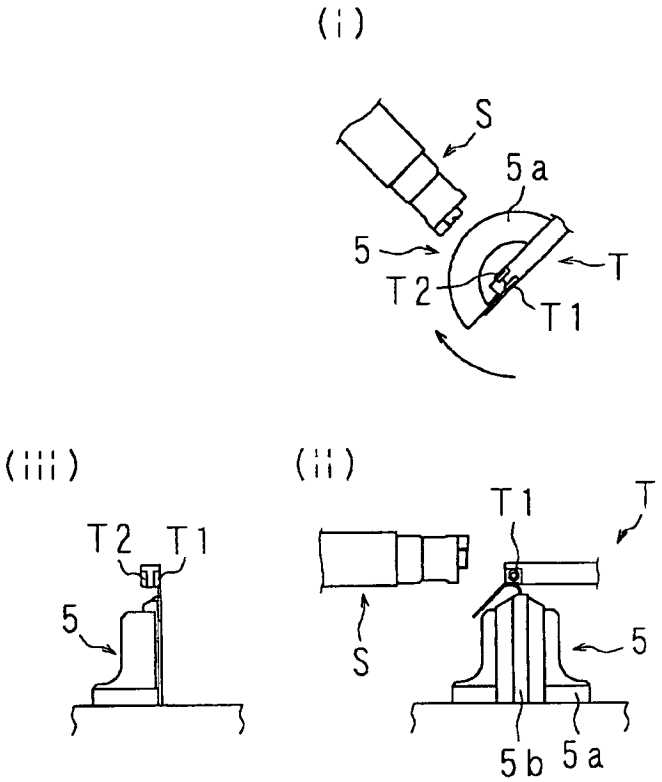
FIGS. 14A and 14B are explanatory views according to Embodiment 1, each explaining movement of the spindle, the bending die, the quill, and the wire rod.
Figure 14A:
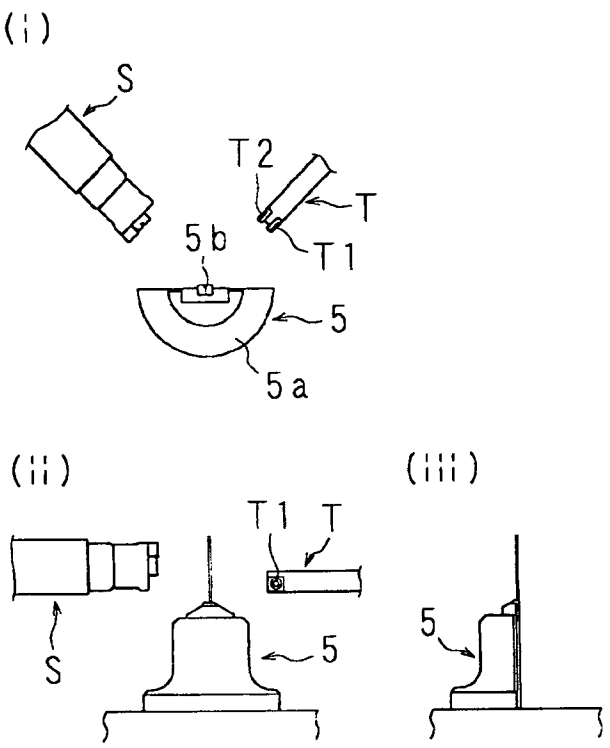
Figure 15A:
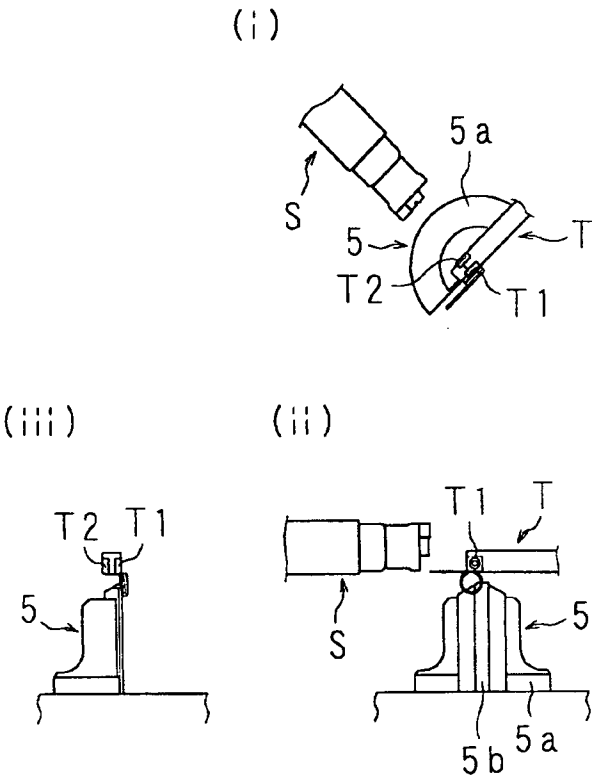
FIGS. 15A and 15B are explanatory views according to Embodiment 1, each explaining the movement of a spindle, the bending die, the quill, and the wire rod.
Figure 15B:
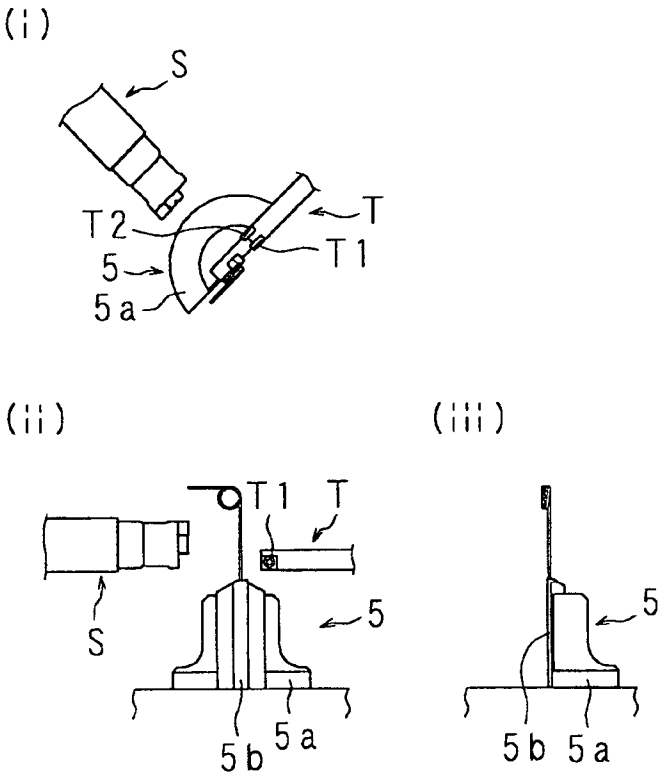
Figures 16A, 16B:
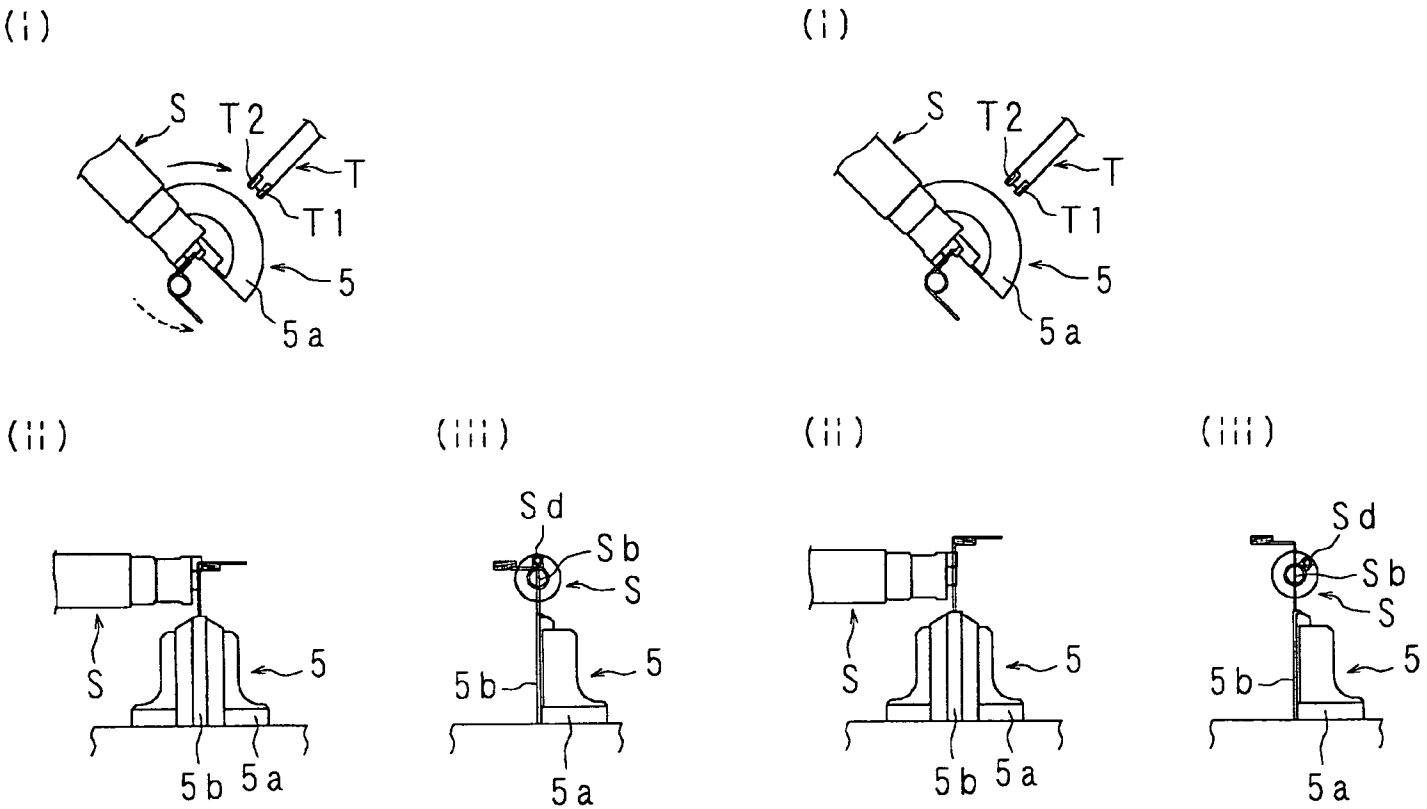
FIGS. 16A and 16B are explanatory views according to Embodiment 1, each explaining the movement of the spindle, the bending die, the quill, and the wire rod.
Figure 17A:
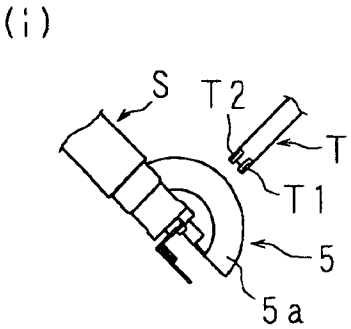
FIGS. 17A and 17B are explanatory views according to Embodiment 1, each explaining the movement of the spindle, the bending die, the quill, and the wire rod.
Figure 17A:
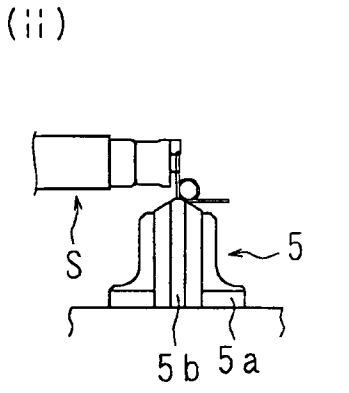
Figure 17B:
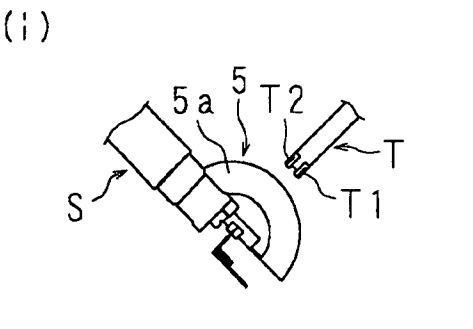
Figure 17B:
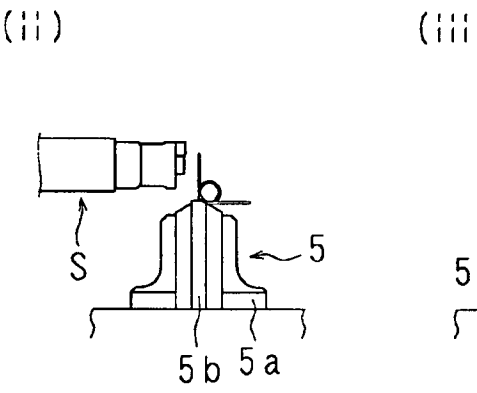
Figure 18B:
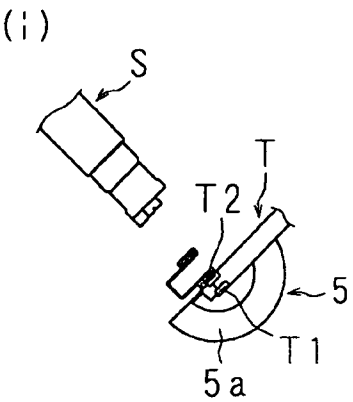
FIGS. 18A and 18B are explanatory views according to Embodiment 1 each explaining the movement of the spindle, the bending die, the quill, and the wire rod.
Figure 18B:
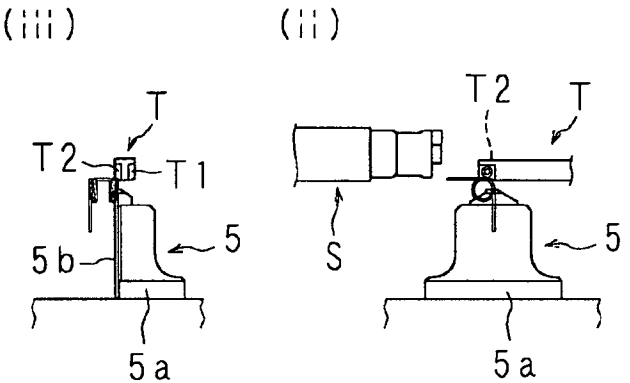
Figure 18A:
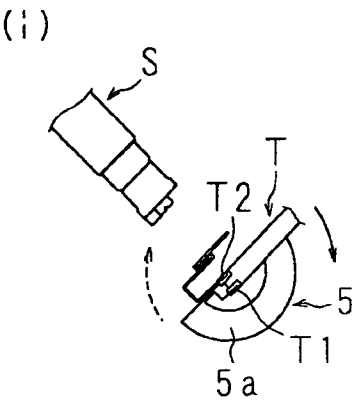
Figure 18A:
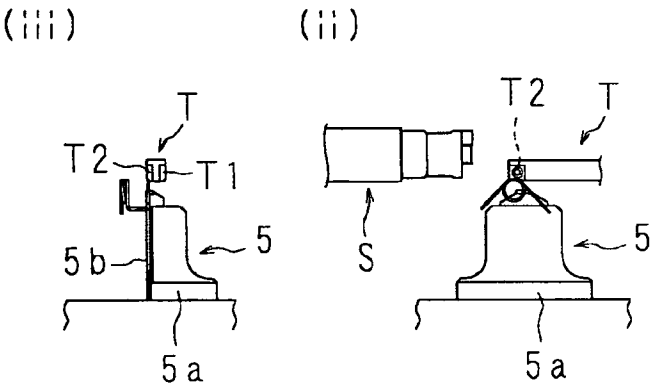
Figure 19B:
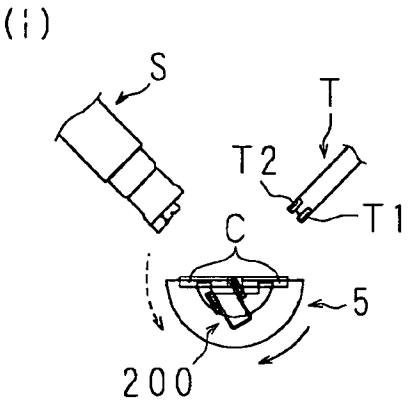
FIGS. 19A and 19B are explanatory views according to Embodiment 1, each explaining the movement of the spindle, the bending die, the quill, and the wire rod.
Figure 19B:
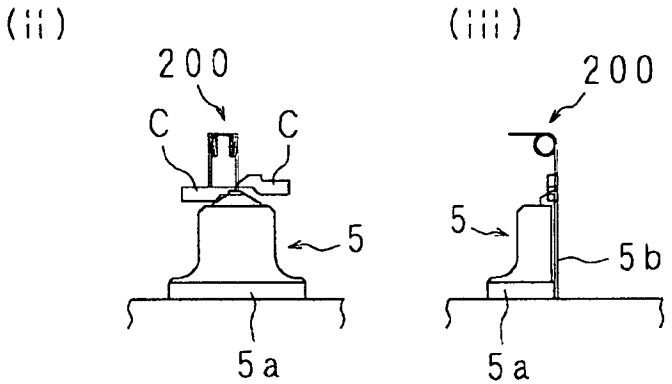
Figure 19A:
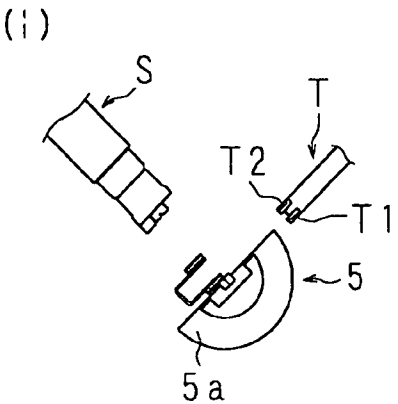
Figure 19A:
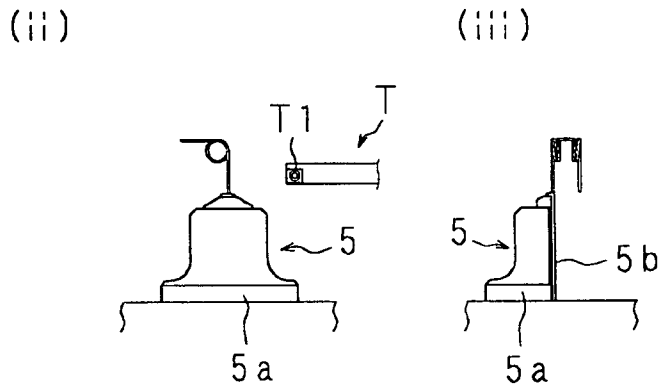

Consequently, a locking tool T, the spindle S, and cutters C, C move away from the wire rod processing space 6, and stay at an initial position being set by the control program (step S3, see FIG. 14A).

The control circuit 60 outputs a signal, to the roller drive circuit 68, that represents to send out the first leg part 200 and makes the servo motor M9 rotate a predetermined number of times (step S4). By the rotation of the servo motor M9, a predetermined length of first leg part 200 is sent out to the wire rod processing space 6. Then, the control circuit 60 outputs a signal, to the quill drive circuit 70, that represents to avoid interference between the processed wire rod and the quill and makes the servo motor M12 rotate the predetermined number of times (step S5). By the rotation of the servo motor M12, the quill 5 is rotated at a predetermined angle in the clockwise direction viewed from the front side, as shown by a solid arrow of FIG. 14B, and stays at a position that does not interfere the processed wire rod. The control circuit 60 outputs a signal to the bending die advancing and retreating drive circuit 66, that represents to make the bending die T move toward the wire rod processing space 6, and makes the servo motor M5 carry out forward rotation with the predetermined number of times (step S6). By the rotation of the servo motor M5, the bending die T moves toward the wire rod processing space 6. Then, the control circuit 60 outputs a signal to the X-axis direction drive circuit 61, the Y-axis directional drive circuit 62, and the Z-axis directional drive circuit 63, that represents to finely adjust the relative position between the bending die T and the quill 5. Consequently, the servo motor M1, the servo motor M2, and the servo motor M3 rotate the predetermined number of times to make the wire rod contact the left winding groove T1 (step S7, see FIG. 14B).

Next, the control circuit 60 outputs a signal to the roller drive circuit 68, that represents to form the left winding coil part 202, and makes the servo motor M9 rotate the predetermined number of times (step S8). By the rotation of the servo motor M9, the wire rod is fed with a predetermined length and contacts the left winding groove T1 to form the left winding coil part 202 (see FIG. 15A).

Then, the control circuit 60 outputs a signal to the bending die advancing and retreating drive circuit 66, that represents to make the bending die T move away from the wire rod processing space 6, and makes the servo motor M5 carry out reverse rotation with the predetermined number of times (step S9). By the rotation of the servo motor M5, the bending die T moves away from the wire rod processing space 6, and the wire rod is prevented from contacting the left winding groove T1 (see FIG. 15B). Next, the control circuit 60 outputs a signal to the unit drive circuit 69, that represents to rotate the wire rod toward a suitable position for processing with the use of the spindle S, and makes the servo motor M10 rotate the predetermined number of times (step S10). By the rotation of the servo motor M10, the wire rod is rotated at a predetermined angle in the counter-clockwise direction viewed from the front side, as shown by a broken arrow of FIG. 16A. Consequently, the wire rod is positioned to make the desired spot contact the protrusion Sd. Then, the control circuit 60 outputs a signal to the quill drive circuit 70, that represents to avoid the interference between the processed wire rod and the quill 5, and makes the servo motor M12 rotate the predetermined number of times (step S11). By the rotation of the servo motor M12, the quill 5 is rotated at a predetermined angle in the clockwise direction viewed from the front side, as shown by the solid arrow of FIG. 16A. Consequently, the quill 5 is kept at a position that does not interfere the processed wire rod.

The control circuit 60 outputs a signal to the spindle advancing and retreating drive circuit 64, that represents to make the spindle S move toward the wire rod processing space 6, and makes the servo motor M6 carry out forward rotation with the predetermined number of times (step S12). By the rotation of the servo motor M6, the spindle S moves toward the wire rod processing space 6. Then, the control circuit 60 outputs a signal to the X-axis directional drive circuit 61, the Y-axis directional drive circuit 62, and the Z-axis directional drive circuit 63, that represents to finely adjust the relative position between the spindle S and the quill 5, and makes the servo motor M1, the servo motor M2, and the servo motor M3 rotate the predetermined number of times to fit the wire rod into the slotted groove Sb (step S13). Next, the control circuit 60 outputs a signal to the spindle rotation drive circuit 65, that represents to form the first bent part 203, and makes the servo motor M8 carry out forward rotation with the predetermined number of times (step S14). By the rotation of the servo motor M8, the outer sleeve Sc rotates in the counter-clockwise direction viewed from the bottom side. Consequently, the protrusion Sd contacts and bends the wire rod. The bending of the wire rod leads to form the first bent part 203 (see FIG. 16A). Then, the control circuit 60 outputs a signal to the spindle rotation drive circuit 65, that represents to cancel the contact of the protrusion Sd with the wire, and makes the servo motor M8 carry out reverse rotation with the predetermined number of times (step S15). By the rotation of the servo motor M8, the protrusion Sd rotates in the clockwise direction viewed from the bottom side. Consequently, the contact of the protrusion Sd with the wire rod is canceled (see FIG. 16B).

The control circuit 60 outputs a signal to the roller drive circuit 68, that represents to feed the wire rod, and makes the servo motor M9 rotates the predetermined number of times (step S16). By the rotation of the servo motor M9, the wire rod is fed with a predetermined length to the wire rod processing space 6 through the slotted groove Sb (see FIG. 16B). Next, the control circuit 60 outputs a signal to the spindle rotation drive circuit 65, that represents to form the second bent part 204, and makes the servo motor M8 carry out forward rotation with the predetermined number of times (step S17). By the rotation of the servo motor M8, the outer sleeve Sc rotates in the counter-clockwise direction viewed from the bottom side. Consequently, the protrusion Sd contacts and bends the wire rod. The bending of the wire rod leads to form the second bent part 204 (see FIG. 17A).

The control circuit 60 outputs a signal to the spindle advancing and retreating circuit 64, that represents to make the spindle S retreat, and makes the servo motor M6 carry out reverse rotation the predetermined number of times (step S18). By the reverse rotation of the servo motor M6, the spindle S moves away from the wire rod processing space 6, to cancel the engagement between the slotted groove Sb and the wire rod (see FIG. 17B). Then, the control circuit 60 outputs a signal to the unit drive circuit 69, that represents to rotate the wire rod toward a suitable position for processing by the bending die T, and makes the servo motor M10 rotate the predetermined number of times (step S19). By the reverse rotation of the servo motor M10, the wire rod rotates at a predetermined angle in the clockwise direction viewed from the front side, as shown by the broken arrow of FIG. 18A. Next, the control circuit 60 outputs a signal to the quill drive circuit 70, that represents to avoid interference between the processed wire rod and the quill 5, and makes the servo motor M12 rotate the predetermined number of times (step S20). By the rotation of the servo motor M12, the quill 5 rotates at a predetermined angle in the clockwise direction viewed from the front side, as shown by the solid arrow of FIG. 18A. Consequently, the quill 5 is kept at a position that does not interfere the processed wire rod.

The control circuit 60 outputs a signal to the bending die advancing and retreating drive circuit 66, that represents to make the bending die T move toward the wire rod processing space 6, and makes the servo motor M5 carry out forward rotation with the predetermined number of times (step S21). By the rotation of the servo motor M5, the bending die T moves toward the wire rod processing space 6. Then, the control circuit 60 outputs a signal to the X-axis directional drive circuit 61, the Y-axis directional drive circuit 62, and the Z-axis directional drive circuit 63, that represents to finely adjust the relative position between the bending die T and the quill 5, and makes the servo motor M1, the servo motor M2, and the servo motor M3 rotate the predetermined number of times to contact the wire rod with the right winding groove T2 (step S22, see FIG. 18A). Next, the control circuit 60 outputs a signal to the roller drive circuit 68, that represents to form the right winding coil part 205, and makes the servo motor M9 rotate the predetermined number of times (step S23). By the rotation of the servo motor M9, the wire rod is fed out with a predetermined length. Consequently, the wire rod contacts the right winding groove T2, to form the right winding coil part 205 (see FIG. 18B).

The control circuit 60 outputs a signal to the bending die advancing and retreating drive circuit 66, that represents to move the bending die T away from the wire rod processing space 6, and makes the servo motor M5 carry out reverse rotation with the predetermined number of times (step S24). By the rotation of the servo motor M5, the bending die T moves away from the wire rod processing space 6. Consequently, the contact of the wire rod with the right winding groove T2 is canceled. Next, the control circuit 60 outputs a signal to the roller drive circuit 68, that represents to form the second leg part 206, and makes the servo motor M9 rotate the predetermined number of times (step S25). By the rotation of the servo motor M9, the second leg part 206 is sent out with a predetermined length to the wire rod processing space 6 (see FIG. 19A).

The control circuit 60 outputs a signal to the unit drive circuit 69, that represents to avoid the interference between the processed wire rod and the cutters C, C, and makes the servo motor M10 rotate the predetermined number of times (step S26). By the rotation of the servo motor M10, the wire rod rotates in the counter-clockwise direction viewed from the front side, as shown by the broken arrow of FIG. 19B. Consequently, the wire rod moves to a position that does not interfere the cutters C, C. Then, the control circuit 60 outputs a signal to the quill drive circuit 70, that represents to avoid the interference between the cutters C, C, and the quill 5, and makes the servo motor M12 rotate the predetermined number of times (step S27). By the rotation of the servo motor M12, the quill 5 rotates at a predetermined angle in the clockwise direction viewed from the front side, as shown by the solid arrow of FIG. 19B. Consequently, the quill moves to a position that does not interfere the cutters C, C.

The control circuit 60 outputs a signal to the cutter drive circuit 67, that represents to cut the wire rod, and makes the servo motor M4 and M4 rotate the predetermined number of times (step S28). By the rotation of the servo motors M4 and M4, the cutters C, C move toward the wire rod processing space 6 to cut the wire rod (see FIG. 19B). Then, the control circuit 60 judges whether or not the switch 51 is turned off (step 29). When the switch 51 is turned on (NO: step 29), the processing returns to step S3, to continue the manufacture of the spring 200. When the switch 51 is turned off (YES: step 29), the manufacturing processing of the spring 200 is ended.

The spring manufacturing apparatus according to Embodiment 1 provides the movable plate 2 moving in the Z-axis direction, to the quill 5. Furthermore, the spring manufacturing apparatus according to Embodiment 1 provides the movable plate 11 moving in the X-axis direction, and the movable plate 12 moving in the Y-axis direction. Therefore, it is possible to prevent the twist of the wire rod with the use of the quill 5 that is shortened in the Z-axis direction, through the reduction of the contact area between the quill 5 and the wire rod.

In addition, the spring manufacturing apparatus according to Embodiment 1 provides the movable plate 11 and the movable plate 12, with a horizontal direction being set as the X-axis direction and a vertical direction being set as the Y-axis direction. Therefore, it is possible to position the movable plate 11 and the movable plate 12, with higher accuracy, for keeping the moving directions orthogonal to each other, when compared with a case that the movable plate 11 and the movable plate 12 are provided with inclined directions from the horizontal direction and the vertical direction being set as the X-axis direction and the Y-axis direction. Thus, it is possible to prevent the positions of the movable plate 11 and the movable plate 12 from deviating greatly with respect to a predetermined position, when the movable plate 11 and the movable plate 12 are assembled.

The spring manufacturing apparatus according to Embodiment 1 provides advancing and retreating mechanisms that move the tool holder 8*e* for holding the bending die T and the spindle operation device 9*c* for holding the spindle S toward and away from the wire rod processing space 6 in which the wire rod is processed. In addition, the spring manufacturing apparatus according to Embodiment 1 provides a section that controls the movement of the advancing and retreating mechanisms, the movable plate 12, and the quill 5. Therefore, it is possible to move the tools at a high speed, through interlocking the movement of the advancing and retreating mechanisms and the movement of the movable plate 12. Moreover, it is possible to adjust the relative position between the quill 5 and the tool with high accuracy, and to manufacture the spring with good accuracy in a short time.

In the spring manufacturing apparatus according to Embodiment 1, the servo motor M10 and the servo motor M11 are connected, via a transmitting member, to the wire feed unit 3 and the quill 5, respectively. Therefore, it is possible to avoid contact of the wire rod with quill 5 by rotating the wire rod through the rotation of the wire feed unit 3 around the shaft core of the wire rod and by avoiding the contact of the tool with a part of the wire rod that is processed into the coil spring through the rotation of the quill 5 around the shaft core of the wire rod.

Moreover, the spring manufacturing apparatus according to Embodiment 1 provides the tool holder 8*e*, the spindle operation device 9*c*, and the opening part $O_3$ that penetrates the movable plate 12 and keeps the quill 5. Furthermore, in the spring manufacturing apparatus according to Embodiment 1, the tool holder 8*e* and the spindle operation device 9*c* are radially arranged on the movable plate 12 and are centered on the opening part $O_3$. Therefore, it is possible to manufacture the spring according to a desired specification by attaching the bending die T and the spindle S to the tool holder 8*e* and the spindle operation device 9*c*. Furthermore, it is possible to make the movable plate 12 absorb an impact that is transmitted to the bending die T and the spindle S when the bending die T and the spindle S contact the wire rod. Consequently, it is possible to prevent a great deviation of the positions of the bending die T and the spindle S from a predetermined position, during processing the wire rod.

Note that a tool other than the bending die T may also be attached to the tool holder 8*e*.

Embodiment 2

Figure 20:
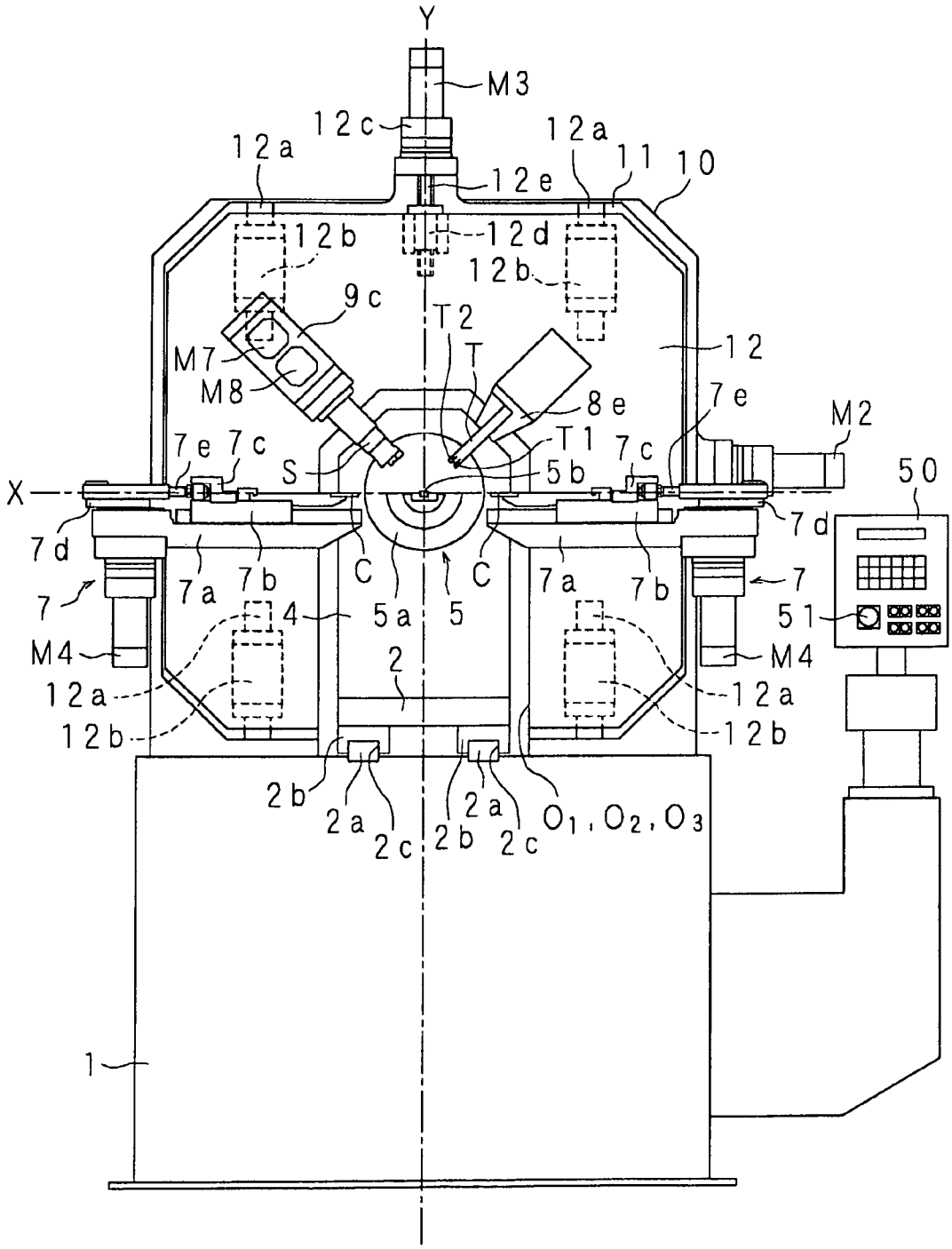
FIG. 20 is a schematic front view of the spring manufacturing apparatus according to Embodiment 2.

The present invention will be described below on the basis of the drawings showing a spring manufacturing apparatus according to Embodiment 2. FIG. 20 is a schematic front view of the spring manufacturing apparatus.

The tool holder 8*e* and the spindle operation device 9*c* are fixed to the movable plate 12. To manufacture a spring, the movable plate 2, the movable plate 11, and the movable plate 12 moves the tool holder 8*e* and the spindle operation device 9*c*, and then the bending die T and the spindle S contact the wire rod.

In the structure of the spring manufacturing apparatus according to Embodiment 2, the same structure as that of Embodiment 1 are assigned same numerals as that of Embodiment 1 and are omitted about detailed description.

Embodiment 3

The present invention will be described in detail below on the basis of the drawings showing a spring manufacturing apparatus according to Embodiment 3.

Figure 21:
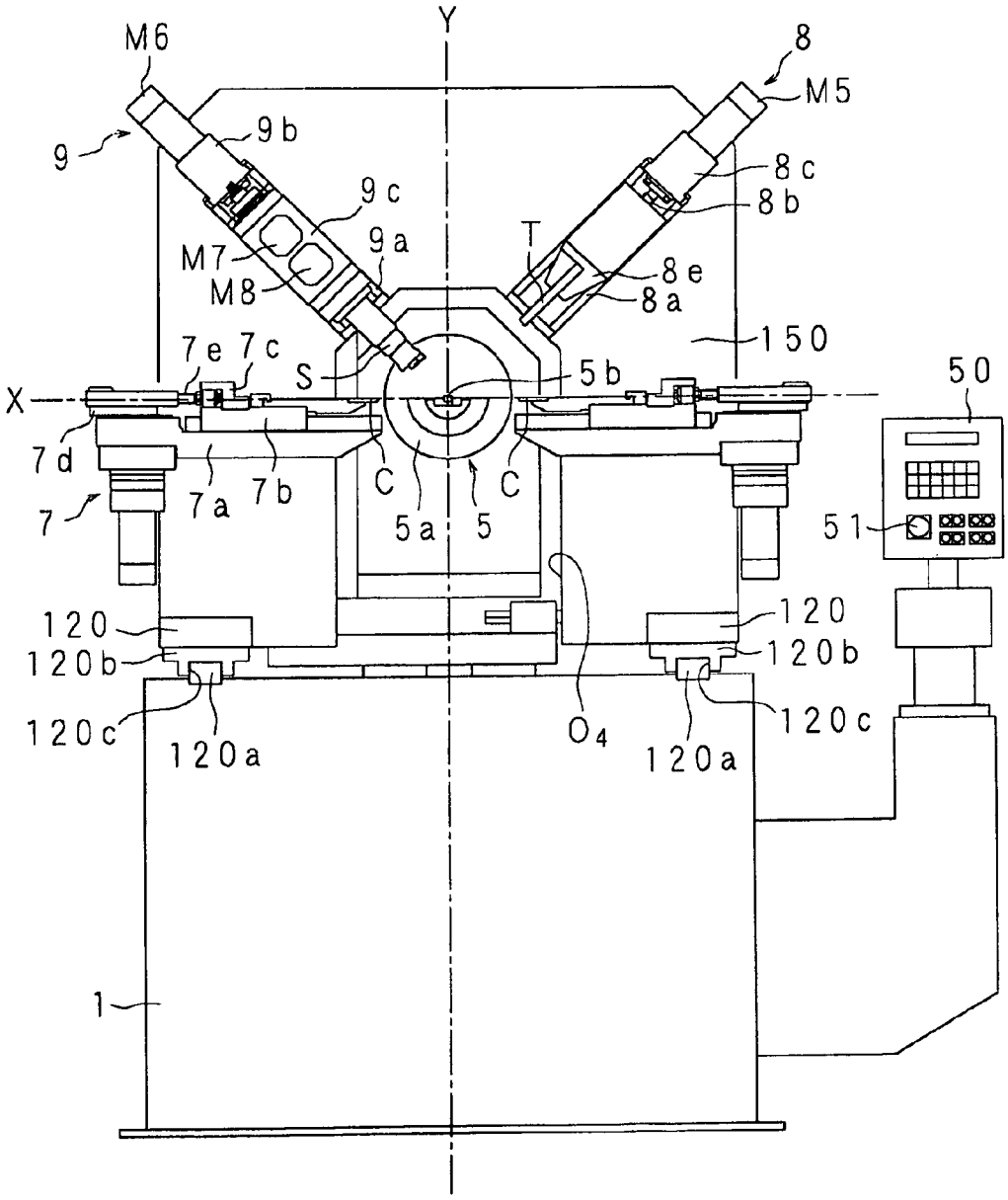
FIG. 21 is a schematic front view of the spring manufacturing apparatus according to Embodiment 3.
Figure 22:
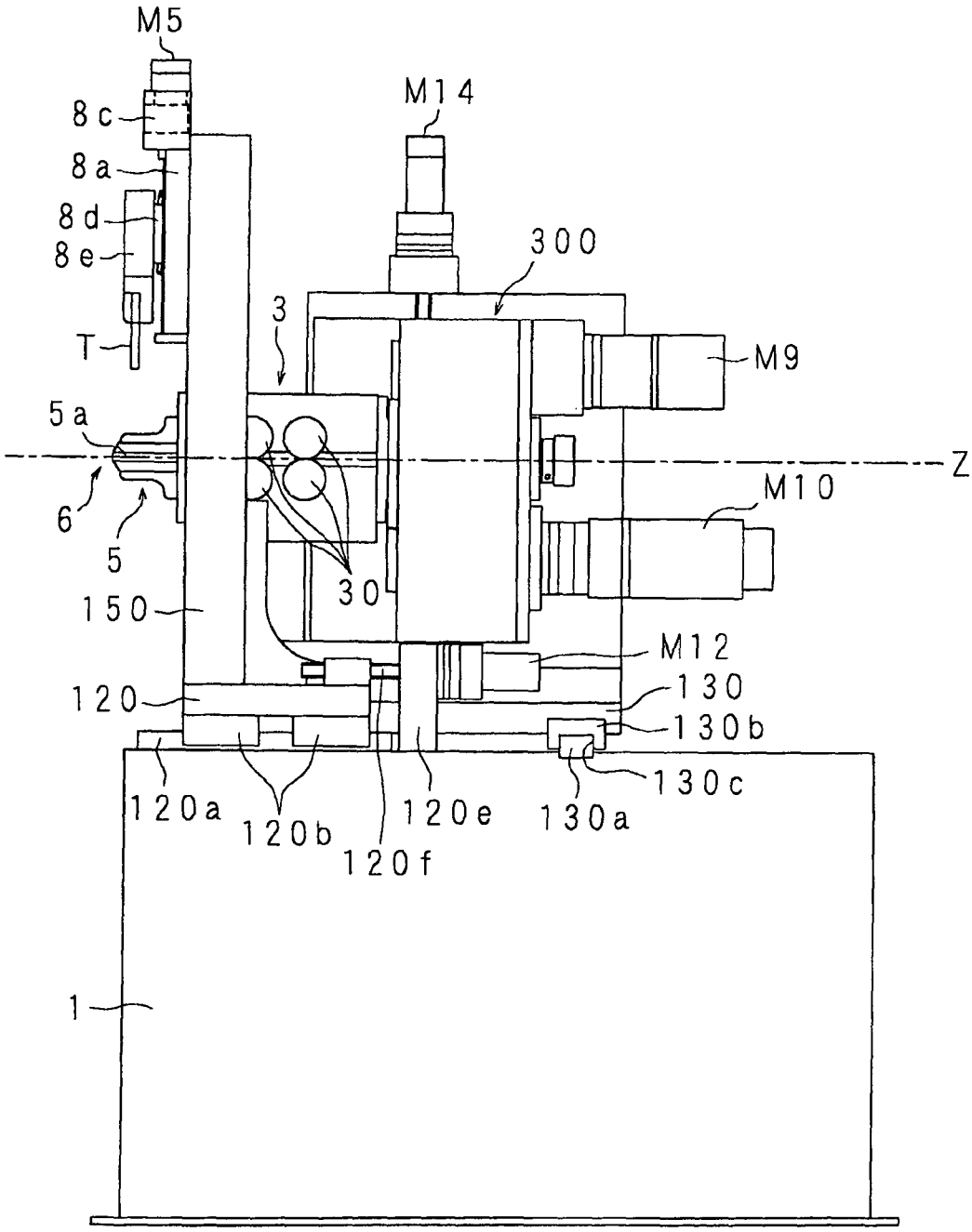
FIG. 22 is a schematic side view of the spring manufacturing apparatus according to Embodiment 3.
Figure 23:
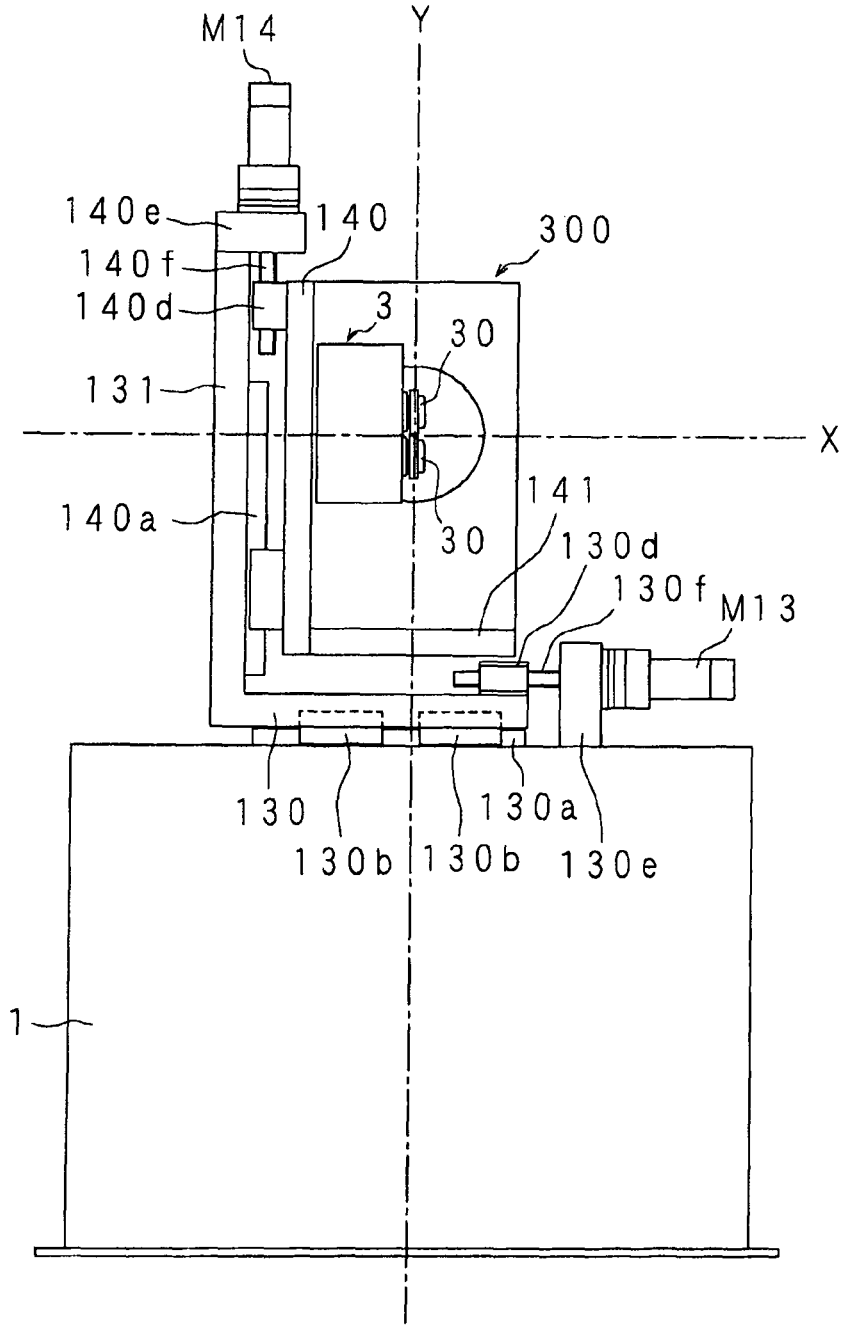
FIG. 23 is a schematic front view of a part in the vicinity of a wire feed unit of the spring manufacturing apparatus according to Embodiment 3.
Figure 24:
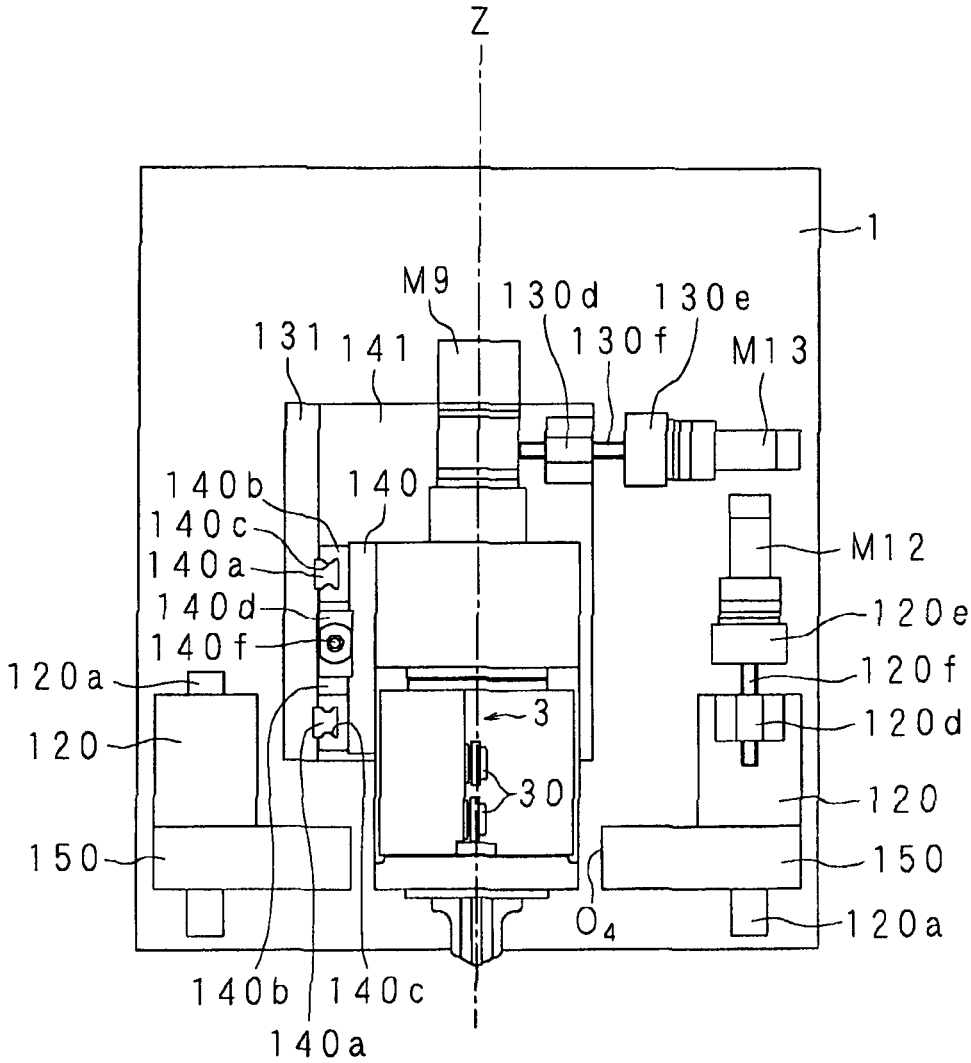
FIG. 24 is a schematic plan view of the spring manufacturing apparatus according to Embodiment 3.
Figure 25:
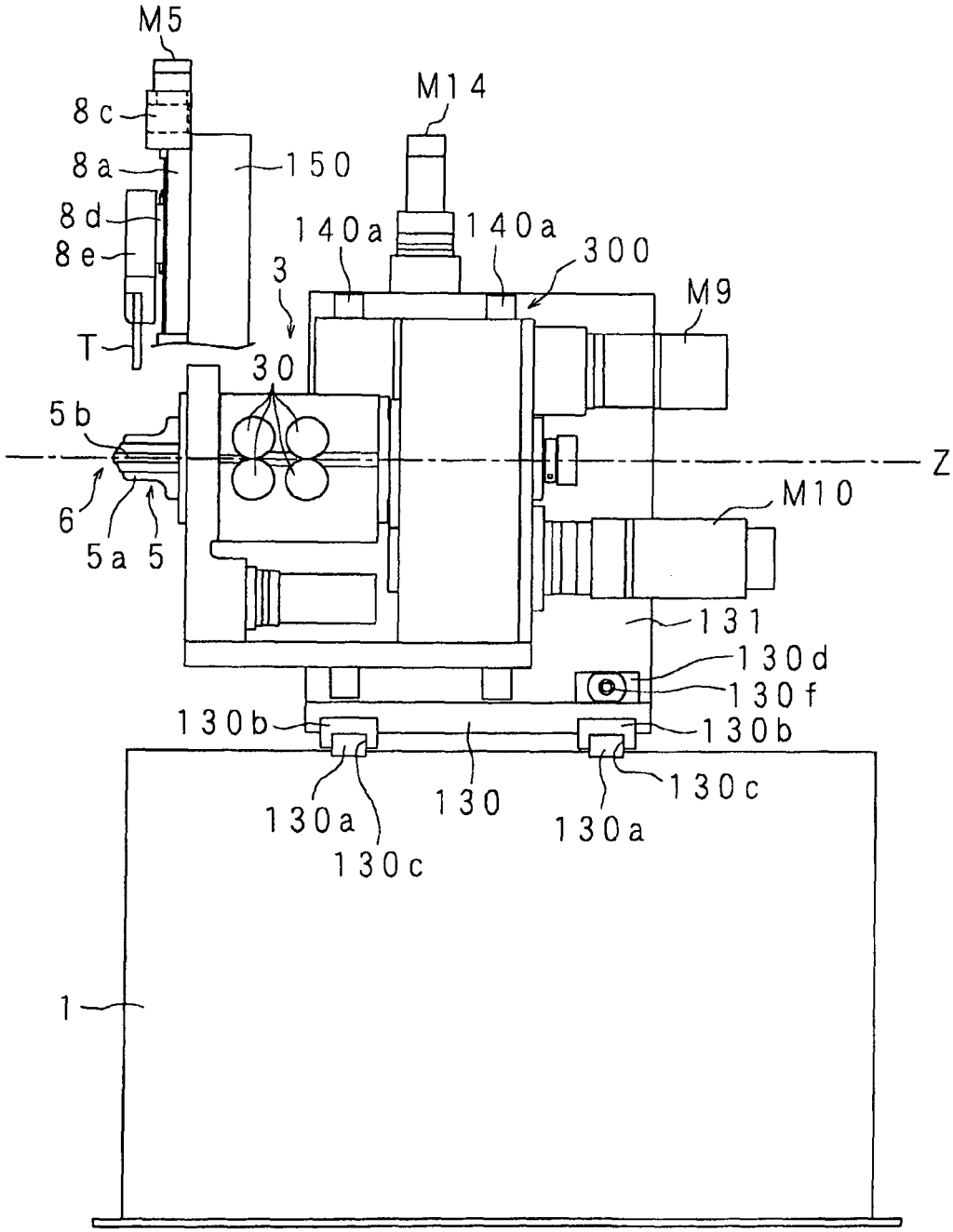
FIG. 25 is a schematic side view of a part in the vicinity of the wire feed unit of the spring manufacturing apparatus according to Embodiment 3.

FIG. 21 is a schematic front view of the spring manufacturing apparatus, FIG. 22 is a schematic side view of the spring manufacturing apparatus, FIG. 23 is a schematic front view of a part in the vicinity of the wire feed unit, FIG. 24 is a schematic plan view of the spring manufacturing apparatus, and FIG. 25 is a schematic side view of a part in the vicinity of the wire feed unit.

The base 1 provides two rails 120*a*, 120*a*, on the top face and at the front-side, that are mutually arranged in parallel along the Z-axis. One of the two rails 120*a*, 120*a* is positioned at the close side to the operation part 50, and the other one of the two rails 120*a*, 120*a* is positioned at the far side to the operation part 50. The two rails 120*a*, 120*a* are opposed to two sliding plates 120, 120, respectively. Each sliding plate 120 includes two sliders 120*b*, 120*b* that slide on the rail 120*a*. The slider 120*b* is formed into approximately a rectangular parallelepiped shape, and provides a groove 120*c* that is formed on a surface opposed to the rails 120*a*. An engagement between the groove 120*c* and the rail 120*a* configures a sliding structure. The sliding plate 120 provides a wall-like frame 150, on the front face, that is arranged in a standing manner. The frame 150 provides an opening part $O_4$ that is formed in an arc shape to open from the close side to base 1 to the center part. The opening part $O_4$ is configured to move the quill 5 and the wire feed unit 3, interiorly.

The sliding plate 120 provides a nut part 120*d* at the backside on the top face. Behind the nut part 120*d*, the base 1 provides a block-like motor fixing part 120*e* on the top face. The motor fixing part 120*e* provides a fitting hole, at the center, that is penetrated in the Z-axis direction. The fitting hole fits the servo motor M12 that is capable of rotating forward and reverse. The servo motor M12 has the rotating shaft that is connected to a male screw 120*f* which is screwed into the nut part 120*d*. The male screw 120*f* and the nut part 120*d* provide the groove parts that fit balls (not shown) in a rotational motion, to configure a ball screw mechanism.

The base 1 provides two rails 130*a*, 130*a*, on the top face and at the center part, that are mutually arranged in parallel along the X-axis, between the rails 120*a*, 120*a*. The two rails 130*a*, 130*a* are opposed to a movable plate 130. This movable plate 130 includes four sliders 130*b*, 130*b*, . . . that slide on the rails 130*a* and 130*a*. The slider 130*b* is formed into approximately a rectangular parallelepiped shape, and provides a groove 130*c* that is formed on the surface opposed to the rails 130*a*. An engagement between the groove 130*c* and the rail 130*a* configures a sliding structure. In addition, the movable plate 130 provides a fitting plate 131, on the far side to the operation part 50, that is arranged in a standing manner and fits rails 140*a*, 140*a* described later.

The movable plate 130 provides a nut part 130*d* at the close side to the operation part 50 on the top face. Between the nut part 130*d* and the operation part 50, the base 1 provides a block-like motor fixing part 130*e* on the top face. The motor fixing part 130*e* provides a fitting hole, at the center, that is penetrated in the X-axis direction. The fitting hole fits the servo motor M13 that is capable of rotating forward and reverse. The servo motor M13 has the rotating shaft that is connected to a male screw 130*f* which is screwed into the nut part 130*d*. The male screw 130*f* and the nut part 130*d* provide the groove parts that fit balls (not shown) in a rotational motion, to configure a ball screw mechanism.

The fitting plate 131 provides two rails 140*a*, 140*a*, on the close side to the operation part 50, that are mutually arranged in parallel along the Y-axis. The two rails 140*a*, 140*a* are opposed to a movable plate 140. This movable plate 140 includes two sliders 140*b*, 140*b* that slide on the rails 140*a*, 140*a*. The slider 140*b* is formed into approximately a rectangular parallelepiped shape, and provides a groove 140*c* that is formed on a surface opposed to the rails 140*a*. An engagement between the groove 140*c* and the rail 140*a* configures a sliding structure. In addition, the movable plates 140 provides an extending plate 141, on the close side to the base 1, that extends toward the operation part 50.

The movable plate 140 provides a nut part 140*d* on the close side to the fitting plate 131 and at the far side to the base 1. The fitting plate 131 provides a block-like motor fixing part 140*e* on the top face far to the base 1. The motor fixing part 140*e* provides a fitting hole, at the center, that is penetrated in the Y-axis direction. The fitting hole fits a servo motor M14 that is capable of rotating forward and reverse. The servo motor M14 has the rotation shaft that is connected a male screw 140*f* which is screwed into the nut part 140*d*. The male screw 140*f* and the nut part 140*d* provide the groove parts that fit balls (not shown) in a rotational motion, to configure a ball screw mechanism.

The movable plate 140 closely contacts a gear box 300, on the side opposed to the operation part 50, that is arranged on the extending plate 141. The extending plate 141 provides the support plate 4, at the front side, that is arranged in a standing manner. The support plate 4 supports the quill 5. Between the gear box 300 and the quill 5, the wire feed unit 3 is arranged to connect the front face of the gear box 300 and the back face of the quill 5.

The gear box 300 provides the servo motors M9 and M10 at the backside. The gear box 300 interiorly provides the main driving gear 90, the driven gear 91, a hub 92, the main driving gear 93, and the driven gear 94, etc. The rotation of the servo motor M9 is transmitted via the main driving gear 90 and the driven gear 91, etc, to the wire feed unit 3 to rotate the wire feed unit 3 around the Z-axis. In addition, the rotation of the servo motor M10 is transmitted via the hub 92, the main driving gear 93, and the driven gear 94, etc, to the wire feed rollers 30 and 30 to feed the wire rod to the quill 5.

The movable plate 120 leads to move the frame 150 in the Z-axis direction. The movable plate 130 and the movable plate 140 lead to move the quill 5 in the X-axis direction and in the Y-axis. Therefore, it is possible to adjust the relative positions between the quill 5 and the bending die T and between the quill 5 and the spindle S.

In the spring manufacturing apparatus according to Embodiment 3, the movable plate 130 moving in the X-axis direction and the movable plate 140 moving in the Y-axis direction are connected to the quill 5. Therefore, it is possible to prevent the twist of the wire rod through reducing the contact area between the quill and the wire rod, with the use of the quill 5 that is shortened in the Z-axis.

In the structure of the spring manufacturing apparatus according to Embodiment 3, the same structure as that of Embodiment 1 are assigned same numerals as that of Embodiment 1 and are omitted about detailed description.

Other Embodiments

The present invention will be described below on the basis of the drawings showing a spring manufacturing apparatus according to other embodiments. FIGS. 26 to 29 are schematic views illustrating the spring manufacturing apparatus according to other embodiments.

Figure 26:
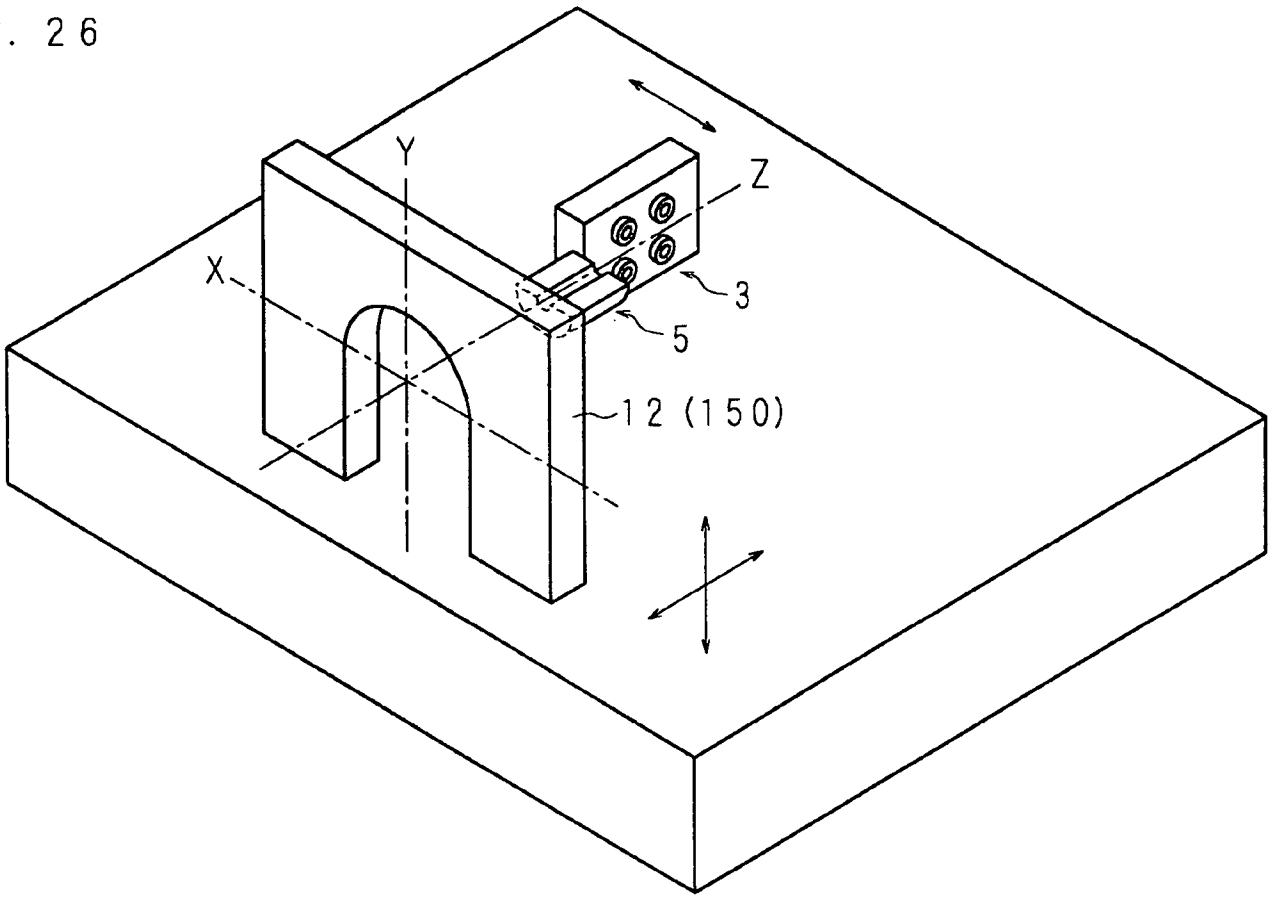
FIG. 26 is a schematic view illustrating a spring manufacturing apparatus according to other embodiment.
Figure 27:
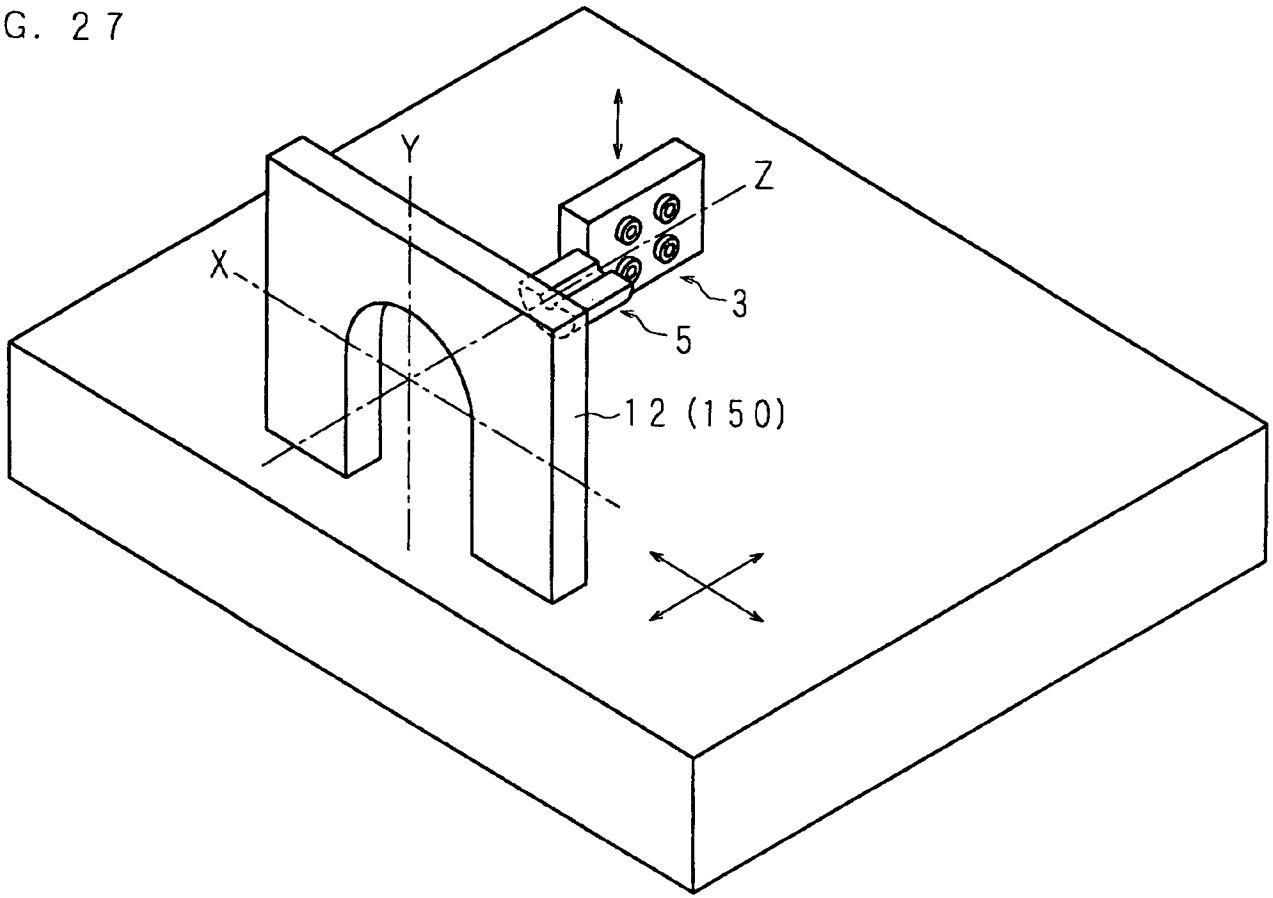
FIG. 27 is a schematic view illustrating the spring manufacturing apparatus according to other embodiment.
Figure 28:
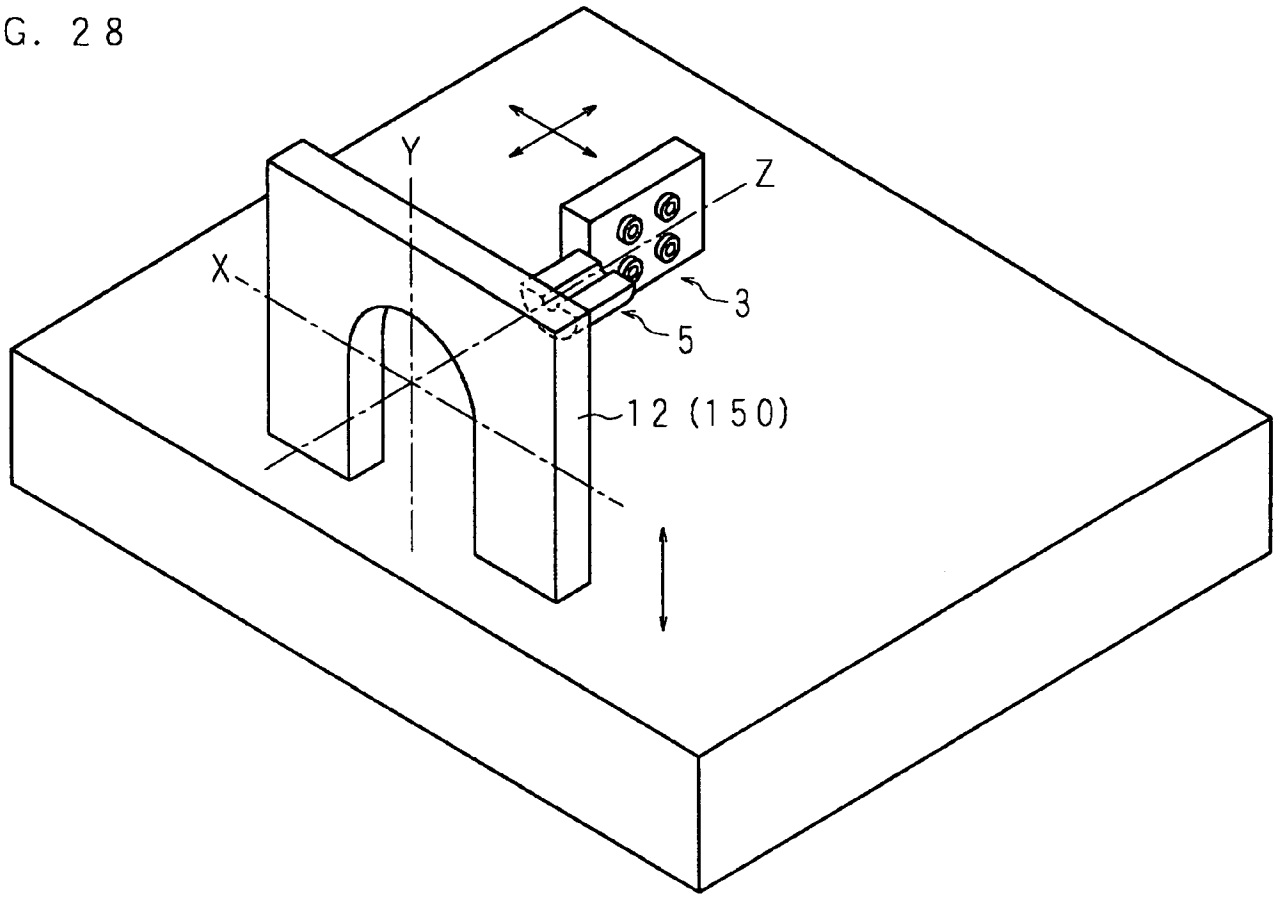
FIG. 28 is a schematic view illustrating the spring manufacturing apparatus according to other embodiment.
Figure 29:
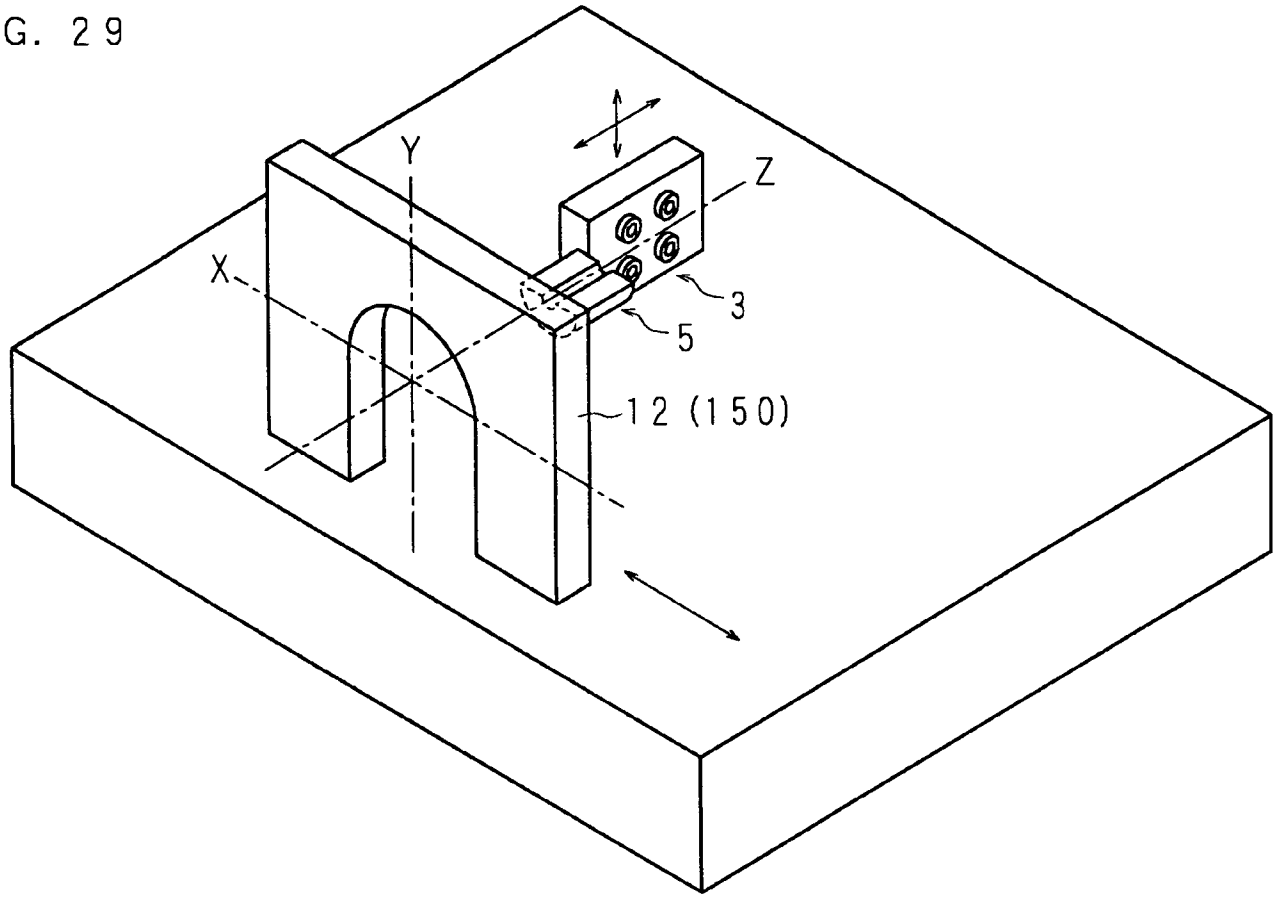
FIG. 29 is a schematic view illustrating the spring manufacturing apparatus according to other embodiment.

As shown by the arrow of FIG. 26, the movable plate 12 or the frame 150 may be configured to move in both direction, i.e. the Y-axis direction and the Z-axis direction, and the quill 5 and the wire feed unit 3 may be configured to move in the X-axis direction, with the use of the movable plate 2, the movable plate 11, the movable plate 12, the movable plate 120, the movable plate 130, and the movable plate 140 shown in Embodiments 1 to 3. Alternately, as shown by the arrow of FIG. 27, the movable plate 12 or the frame 150 may be configured to move in both direction, i.e. the X-axis direction and the Z-axis direction, and the quill 5 and the wire feed unit 3 may be configured to move in the Y-axis direction. In addition, as shown by the arrow of FIG. 28, the movable plate 12 or the frame 150 may be configured to move in the Y-axis direction, and the quill 5 and the wire feed unit 3 may be configured to move in both direction, i.e. the X-axis direction and the Z-axis direction. Moreover, as shown by the arrow of FIG. 29, the movable plate 12 or the frame 150 may be configured to move in the X-axis direction, and the quill 5 and the wire feed unit 3 may be configured to move in both direction, i.e. the Y-axis direction and the Z-axis direction.

As this invention may be embodied in several forms without departing from the spirit of essential characteristics thereof, the present embodiments are therefore illustrative and not restrictive, since the scope of the invention is defined by the appended claims rather than by description preceding them, and all changes that fall within metes and bounds of the claims, or equivalence of such metes and bounds thereof are therefore intended to be embraced by the claims.

What is claimed is:

1. A spring manufacturing apparatus comprising:
a wire feed unit that feeds a wire rod;
a quill that guides the wire rod fed from the wire feed unit;
a quill supporting member that supports the quill;
a tool holder that holds a tool which processes the wire rod into a coil spring;
a tool holder supporting member that supports the tool holder; and
an X-axis movable body that moves in an X-axis direction, a Y-axis movable body that moves in a Y-axis direction, a Z-axis movable body that moves in a Z-axis direction, in an XYZ orthogonal coordinate system representing an axial direction of the quill as the Z-axis direction;
wherein the quill supporting member comprises one of the movable body among the X-axis movable body, the Y-axis movable body, and the Z-axis movable body; and
the tool holder supporting member comprises said X-axis, Y-axis, and Z-axis movable bodies other than said movable body which the quill supporting member comprises.

2. A spring manufacturing apparatus according to claim 1, wherein
the X-axis direction is a horizontal direction, and the Y-axis direction is a vertical direction.

3. A spring manufacturing apparatus according to claim 2, further comprising:
a control unit that controls movement of the X-axis movable body, the Y-axis movable body, and the Z-axis movable body.

4. A spring manufacturing apparatus according to claim 2, further comprising:
a sliding unit that slides the tool holder towards and away from a space in which the wire rod is processed.

5. A spring manufacturing apparatus according to claim 2, further comprising:
a plurality of driving sources that are connected via transmitting members to the wire feed unit and the quill,
wherein the driving sources rotate the wire feed unit and the quill around the Z-axis.

6. A spring manufacturing apparatus according to claim 2, wherein
the tool holder supporting member comprises an opening part that is penetrated in the Z-axis direction, at a position where the quill is arranged;
plural tool holders are provided; and
the plural tool holders are arranged radially around the opening part.

7. A spring manufacturing apparatus according to claim 1, further comprising:
a control unit that controls movement of the X-axis movable body, the Y-axis movable body, and the Z-axis movable body.

8. A spring manufacturing apparatus according to claim 7, further comprising;
a plurality of driving sources that are connected via transmitting members to the wire feed unit and the quill,
wherein the driving sources rotate the wire feed unit and the quill around the Z-axis.

9. A spring manufacturing apparatus according to claim 7, wherein
the tool holder supporting member comprises an opening part that is penetrated in the Z-axis direction, at a position where the quill is arranged;
plural tool holders are provided; and
the plural tool holders are arranged radially around the opening part.

10. A spring manufacturing apparatus according to claim 1, further comprising:
a sliding unit that slides the tool holder towards and away from a space in which the wire rod is processed.

11. A spring manufacturing apparatus according to claim 10, further comprising:
a plurality of driving sources that are connected via transmitting members to the wire feed unit and the quill,
wherein the driving sources rotate the wire feed unit and the quill around the Z-axis.

12. A spring manufacturing apparatus according to claim 10, wherein
the tool holder supporting member comprises an opening part that is penetrated in the Z-axis direction, at a position where the quill is arranged;
plural tool holders are provided; and the plural tool holders are arranged radially around the opening part.

13. A spring manufacturing apparatus according to claim 1, further comprising:

a plurality of driving sources that are connected via transmitting members to the wire feed unit and the quill, wherein the driving sources rotate the wire feed unit and the quill around the Z-axis.

14. A spring manufacturing apparatus according to claim 1, wherein the tool holder supporting member comprises an opening part that is penetrated in the Z-axis direction, at a position where the quill is arranged;

plural tool holders are provided; and the plural tool holders are arranged radially around the opening part.

15. A spring manufacturing apparatus comprising:

a wire feed unit that feeds a wire rod;

a quill that guides the wire rod fed from the wire feed unit;

a quill supporting member that supports the quill;

a tool holder that holds a tool which processes the wire rod into a coil spring;

a tool holder supporting member that supports the tool holder; and an X-axis movable body that moves in an X-axis direction, a Y-axis movable body that moves in a Y-axis direction, a Z-axis movable body that moves in a Z-axis direction, in an XYZ orthogonal coordinate system representing an axial direction of the quill as the Z-axis direction;

wherein the tool holder supporting member comprises one of the movable body among the X-axis movable body, the Y-axis movable body, and the Z-axis movable body; and the quill supporting member comprises said X-axis, Y-axis, and Z-axis movable bodies other than said movable body which the tool holder comprises.

16. A spring manufacturing apparatus according to claim 15, wherein the X-axis direction is a horizontal direction, and the Y-axis direction is a vertical direction.

17. A spring manufacturing apparatus according to claim 15, further comprising:

a control unit that controls movement of the X-axis movable body, the Y-axis movable body, and the Z-axis movable body.

18. A spring manufacturing apparatus according to claim 15, further comprising:

a sliding unit that slides the tool holder towards and away from a space in which the wire rod is processed.

19. A spring manufacturing apparatus according to claim 15, further comprising:

a plurality of driving sources that are connected via transmitting members to the wire feed unit and the quill, wherein the driving sources rotate the wire feed unit and the quill around the Z-axis.

20. A spring manufacturing apparatus according to claim 15, wherein the tool holder supporting member comprises an opening part that is penetrated in the Z-axis direction, at a position where the quill is arranged;

plural tool holders are provided; and the plural tool holders are arranged radially around the opening part.

* * * * *